US007185380B2

(12) United States Patent
Barnabas et al.

(10) Patent No.: US 7,185,380 B2
(45) Date of Patent: Mar. 6, 2007

(54) METHODS FOR LAUNDERING DELICATE GARMENTS IN A WASHING MACHINE COMPRISING A WOVEN ACRYLIC COATED POLYESTER GARMENT CONTAINER

(75) Inventors: Freddy Arthur Barnabas, West Chester, OH (US); Michael Timothy Creedon, Cincinnati, OH (US); John Downing Curry, Oxford, OH (US); Jack Austin Doty, Greenhills, OH (US); Thomas Charles Hortel, Cincinnati, OH (US); Ingrid Rose-Marie Maerten, Zaventem (BE); Natsuko Nishio, Kobe (JP); Yana Milligan Nicks, Cincinnati, OH (US); Mitsuyo Okamoto, Kobe (JP); Nabil Yaqub Sakkab, Brussels (BE); John G. Schroeder, Mason, OH (US); Michael Peter Siklosi, Cincinnati, OH (US); Fernado Ray Tolléns, Indian Hill, OH (US); Errol Hoffman Wahl, Cincinnati, OH (US); Todd Michael Wernicke, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 459 days.

(21) Appl. No.: 10/107,586

(22) Filed: Mar. 27, 2002

(65) Prior Publication Data

US 2003/0008799 A1 Jan. 9, 2003

Related U.S. Application Data

(63) Continuation-in-part of application No. 09/648,219, filed on Aug. 25, 2000, now abandoned.

(60) Provisional application No. 60/157,082, filed on Oct. 1, 1999, provisional application No. 60/157,399, filed on Oct. 1, 1999, provisional application No. 60/105,539, filed on Oct. 24, 1998.

(51) Int. Cl.
*D06F 35/00* (2006.01)
*C11D 1/65* (2006.01)

(52) U.S. Cl. ..... 8/159; 8/133; 8/137; 510/276; 510/292

(58) Field of Classification Search ..... 510/276, 510/292; 8/159, 133, 137
See application file for complete search history.

(56) References Cited

U.S. PATENT DOCUMENTS 503,355 A 8/1893 Phlilips (Continued)

FOREIGN PATENT DOCUMENTS

DE 25 47 588 4/1977

(Continued)

OTHER PUBLICATIONS

Jumbo Size Laundry Net—Advertisement (Japanese Translation Attached).

*Primary Examiner*—Charles Boyer
(74) *Attorney, Agent, or Firm*—Julia A. Glazer; Jeffrey V. Bamber; Kim William Zerby

(57) ABSTRACT

A product and process for laundering delicate or dry-clean only garments in a washing machine, such as a conventional home washing machine. The process may utilize a garment container, such as a flexible wrap to protect the garments. The process also includes at least one cleaning composition specially formulated for delicate garments. The cleaning composition(s) can be in a number of suitable forms, and can be introduced into the process in a number of different manners. The products used in the process may be provided in the form of a kit. The kit may also include a pretreatment applicator.

5 Claims, 20 Drawing Sheets

U.S. PATENT DOCUMENTS

| | | | | | |
|---|---|---|---|---|---|
| 1,385,695 | A | | 7/1921 | MacCormack | |
| 3,029,852 | A | | 4/1962 | Taylor | |
| 3,852,090 | A | * | 12/1974 | Leonard et al. | 442/63 |
| 3,906,753 | A | | 9/1975 | Siegfried | |
| 4,102,825 | A | | 7/1978 | Murata et al. | |
| 4,195,378 | A | | 4/1980 | Parker | |
| 4,267,077 | A | | 5/1981 | Niimi et al. | |
| 4,336,024 | A | | 6/1982 | Rossard et al. | |
| 4,421,657 | A | | 12/1983 | Allen et al. | |
| 4,630,312 | A | * | 12/1986 | Milstein | 383/86 |
| 4,662,517 | A | | 5/1987 | Wirth | |
| 4,714,479 | A | | 12/1987 | Wilsberg | |
| 4,746,455 | A | | 5/1988 | Matsuda et al. | |
| 4,750,907 | A | | 6/1988 | Wilsberg | |
| 4,781,041 | A | | 11/1988 | Fowler | |
| 4,846,982 | A | | 7/1989 | Madore et al. | |
| 4,911,852 | A | | 3/1990 | Coffindaffer et al. | |
| 4,978,462 | A | | 12/1990 | Sheppard | |
| 4,978,471 | A | | 12/1990 | Starch | |
| 4,983,315 | A | * | 1/1991 | Glogowski et al. | 510/480 |
| 4,989,995 | A | * | 2/1991 | Rubenstein et al. | 383/117 |
| 5,026,489 | A | | 6/1991 | Snow et al. | |
| 5,057,240 | A | | 10/1991 | Madore et al. | |
| 5,082,466 | A | * | 1/1992 | Rubenstein et al. | 8/142 |
| 5,091,105 | A | | 2/1992 | Madore et al. | |
| 5,110,506 | A | | 5/1992 | Ciallella | |
| 5,114,706 | A | | 5/1992 | DuVel | |
| 5,199,120 | A | | 4/1993 | Holmes | |
| 5,254,269 | A | | 10/1993 | Taylor et al. | |
| 5,288,431 | A | | 2/1994 | Huber et al. | |
| 5,354,491 | A | | 10/1994 | Bjorkquist et al. | |
| 5,536,493 | A | | 7/1996 | Dubief | |
| 5,614,484 | A | | 3/1997 | Panandiker | |
| 5,648,327 | A | | 7/1997 | Smerznak et al. | |
| 5,661,988 | A | | 9/1997 | Oh et al. | |
| 5,674,832 | A | | 10/1997 | Keys | |
| 5,681,355 | A | | 10/1997 | Davis et al. | |
| 5,681,808 | A | | 10/1997 | Kobayashi et al. | |
| 5,687,591 | A | | 11/1997 | Siklosi et al. | |
| 5,714,446 | A | | 2/1998 | Bartz et al. | |
| 5,723,426 | A | | 3/1998 | Zhen et al. | |
| 5,747,433 | A | | 5/1998 | Wahl et al. | |
| 5,747,443 | A | | 5/1998 | Wahl et al. | |
| 5,753,079 | A | | 5/1998 | Jenny et al. | |
| 5,759,208 | A | | 6/1998 | Zhen et al. | |
| 5,759,990 | A | | 6/1998 | Wahl et al. | |
| 5,762,647 | A | | 6/1998 | Kais r | |
| 5,789,368 | A | | 8/1998 | You et al. | |
| 5,824,635 | A | | 10/1998 | Keys | |
| 5,830,845 | A | | 11/1998 | Trinh et al. | |
| 5,861,370 | A | | 1/1999 | Trinh et al. | |
| 5,877,145 | A | | 3/1999 | Wahl et al. | |
| 5,977,055 | A | | 11/1999 | Trinh et al. | |
| 6,040,286 | A | | 3/2000 | Huff | |
| 6,053,952 | A | | 4/2000 | Brown et al. | |
| 6,061,849 | A | | 5/2000 | Seals | |
| 6,070,282 | A | * | 6/2000 | Underly et al. | 8/159 |
| 6,139,587 | A | | 10/2000 | Nair et al. | |
| 6,223,367 | B1 | | 5/2001 | French et al. | |
| 6,323,172 | B1 | | 11/2001 | Trinh et al. | |
| 6,335,315 | B1 | | 1/2002 | Trinh et al. | |
| 6,369,025 | B1 | | 4/2002 | Trinh et al. | |
| 2003/0008799 | A1 | | 1/2003 | Barnabas et al. | |

FOREIGN PATENT DOCUMENTS

| | | | | |
|---|---|---|---|---|
| DE | 25 47 588 | A | | 4/1977 |
| DE | 28 32 679 | | | 2/1979 |
| DE | 34 11 084 | | | 1/1986 |
| DE | 286179 | A5 | | 1/1991 |
| EP | 0 387 658 | | | 9/1990 |
| EP | 0 394 689 | | | 10/1990 |
| EP | 0 630 855 | | | 12/1994 |
| EP | 0 342 834 | B1 | | 1/1995 |
| EP | 1 018 541 | | | 7/2000 |
| GB | 2 054 635 | | | 2/1981 |
| GB | 2 078 670 | | | 1/1982 |
| GB | 2 245 281 | A | | 1/1992 |
| GB | 2 302 553 | | | 1/1997 |
| GB | 2 330 148 | A | | 4/1999 |
| JP | 09-242905 | | | 9/1986 |
| JP | 08-029757 | | | 6/1987 |
| JP | 02-180296 | | | 7/1990 |
| JP | 04-036394 | | | 2/1992 |
| JP | 04-144592 | | | 5/1992 |
| JP | 06-293499 | | | 1/1993 |
| JP | 05-293290 | | | 11/1993 |
| JP | 07-080184 | | | 3/1995 |
| JP | 07-124377 | | | 5/1995 |
| JP | 07-289778 | | * | 11/1995 |
| JP | 07-328279 | | | 12/1995 |
| JP | 08-098986 | | | 4/1996 |
| JP | 08-196778 | | | 8/1996 |
| JP | 09-056973 | | | 3/1997 |
| JP | 09-067594 | | | 3/1997 |
| JP | 09-075580 | | | 3/1997 |
| JP | 09-105077 | | | 4/1997 |
| JP | 09-131489 | | | 5/1997 |
| JP | 09-140988 | | | 6/1997 |
| JP | 09-201487 | | * | 8/1997 |
| JP | 09-215892 | | | 8/1997 |
| JP | 09-220394 | | | 8/1997 |
| JP | 09-234294 | | | 9/1997 |
| JP | 09-271597 | | | 10/1997 |
| JP | 10-005487 | | | 1/1998 |
| JP | 10-015282 | | | 1/1998 |
| JP | 10-015283 | | * | 1/1998 |
| JP | 10-015284 | | * | 1/1998 |
| JP | 10-015285 | | | 1/1998 |
| JP | 10-028790 | | | 2/1998 |
| JP | 10-057667 | | | 3/1998 |
| JP | 10-060480 | | | 3/1998 |
| JP | 10-060483 | | | 3/1998 |
| JP | 10-071295 | | | 3/1998 |
| JP | 10-118386 | | | 5/1998 |
| JP | 10-137486 | | | 5/1998 |
| JP | 10-151292 | | | 6/1998 |
| JP | 10-158693 | | | 6/1998 |
| JP | 10-158962 | | | 6/1998 |
| JP | 10-179499 | | | 7/1998 |
| JP | 10-201992 | | | 8/1998 |
| JP | 10-235074 | | | 9/1998 |
| JP | 10-249090 | | | 9/1998 |
| JP | 10-251962 | | | 9/1998 |
| JP | 10-305188 | | | 11/1998 |
| JP | 11-004992 | | | 1/1999 |
| JP | 08-218855 | | | 3/1999 |
| JP | 11-057278 | | | 3/1999 |
| JP | 11-076677 | | | 3/1999 |
| JP | 11-123297 | | | 5/1999 |
| JP | 11-156083 | | | 6/1999 |
| JP | 11-169587 | | | 6/1999 |
| JP | 11-172592 | | | 6/1999 |
| JP | 11-197387 | | | 7/1999 |
| JP | 11-207079 | | | 8/1999 |
| JP | 11-253689 | | | 9/1999 |
| JP | 11-300079 | | | 11/1999 |
| JP | 11-300080 | | | 11/1999 |
| JP | 11-319369 | | | 11/1999 |
| JP | 11-333195 | | | 12/1999 |
| JP | 11-347284 | | | 12/1999 |
| JP | 00-14965 | | | 1/2000 |
| JP | 00-024376 | | | 1/2000 |
| JP | 00-070587 | | | 3/2000 |

| | | |
|---|---|---|
| JP | 00-107486 | 4/2000 |
| JP | 00-116981 | 4/2000 |
| JP | 00-116983 | 4/2000 |
| WO | WO 97/00992 | 1/1997 |
| WO | WO 97/03169 | 1/1997 |
| WO | WO 97/03169 A1 | 1/1997 |
| WO | WO 97/07278 | 2/1997 |
| WO | WO 97/12019 | 4/1997 |
| WO | WO 97/12019 A1 | 4/1997 |
| WO | WO 97/12022 | 4/1997 |
| WO | WO 97/12027 | 4/1997 |
| WO | WO 97/27354 | 7/1997 |
| WO | WO 97/41291 | 11/1997 |
| WO | WO 98/04770 | 2/1998 |
| WO | WO 99/12988 | 3/1999 |
| WO | WO 99/18177 | 4/1999 |
| WO | WO 00/24857 | 5/2000 |
| WO | WO 00/24860 | 5/2000 |
| WO | WO 00/24958 | 5/2000 |

* cited by examiner

METHODS FOR LAUNDERING DELICATE GARMENTS IN A WASHING MACHINE COMPRISING A WOVEN ACRYLIC COATED POLYESTER GARMENT CONTAINER

This application claims the benefit of U.S. Provisional Application Nos. 60/105,539, filed Oct. 24, 1998; and No. 60/157,082 and No. 60/157,399, filed Oct. 1, 1999, PCT applications PCT/US99/24937 and PCT/US99/24938, both filed Oct. 22, 1999, and is a continuation-in-part of U.S. patent application Ser. No. 09/648,219, filed Aug. 25, 2000 now abandoned.

TECHNICAL FIELD

The present invention relates to products and processes for laundering delicate or dry-clean only garments in a washing machine.

BACKGROUND OF THE INVENTION

By definition, the term "dry cleaning" has been used to describe processes for cleaning textiles using non-aqueous solvents. Dry cleaning is an old art with solvent cleaning first being recorded in the United Kingdom in the 1860s. Typically, dry cleaning processes are used with delicate fabrics such as wool and silk which are subject to shrinkage in aqueous laundering baths, or which are judged to be too valuable or delicate to be subjected to aqueous laundering processes. Such garments usually have a tag affixed to them either identifying the garment as "dry clean only" or providing some other appropriate laundering tocsin. For the last fifty years, the most widely-used non-aqueous solvent of choice for commercial dry-cleaning has been perchloroethylene.

While perchloroethylene is superior to the non-aqueous solvents that it replaced, it has several disadvantages. In particular perchloroethylene has been identified as a hazardous air pollutant by the U.S. Environmental Protection Agency and has been long associated with nervous-system and kidney disorders among industrial workers. In 1995, the Environmental Protection Agency classified perchloroethylene as a "probable human carcinogen." Perchloroethylene's potential carcinogenic effects are not limited solely to industrial workers or those who operate perchloroethylene-based dry clean processes: a recent study of commercial dry cleaners in New York revealed that many of these cleaners used such high amounts of perchloroethylene to clean garments, that customers who wore freshly dry-cleaned garments could inhale enough perchloroethylene to incur a slightly increased risk of cancer. As a consequence of the hazardous nature of perchloroethylene, dry cleaning processes utilizing perchloroethylene must be done at commercial establishments. Not only is this both inconvenient and expensive, but it can expose delicate and often expensive garments to dry-cleaning processes of inconsistent quality and garment care. Many consumers who have taken their goods to a commercial dry-cleaner have reported them being damaged either by excessive shrinking, discoloration or tearing. The use of perchloroethylene in commercial dry-cleaning establishments also tends to leave a "chemical" smell on clothing that consumers find unsatisfactory.

Moreover, while solvent-based dry cleaning processes are quite effective for removing oily soils and stains, they are not optimal for removing particulates such as clay soils, and may require special treatment conditions to remove proteinaceous stains.

Given the foregoing, there is a continuing need for a method or process that provides excellent cleaning benefits on a variety of stains and soiling conditions and imparts a "fresh" and "clean" scent to delicate or dry-clean only goods without the use of hazardous or harmful chemicals and which provides excellent cleaning benefits on a variety of stains and soiling conditions. Accordingly, it is a feature of the present invention to provide a process for cleaning delicate or dry-clean only garments that uses non-toxic and non-hazardous chemicals to provide superior cleaning benefits on a wide variety of soils and stains. Such a method or process should also be relatively convenient and inexpensive and be without the possible garment damage and adverse "chemical" scent that is sometimes the result of commercial dry-cleaning.

Ideally, particulates and proteinaceous stains, as well as oily soils and stains, are removed from fabrics using detersive ingredients and under operating conditions which are more akin to aqueous laundering processes than to conventional dry cleaning. Such aqueous laundry processes also consistently impart a "freshness" or "clean" scent to fabric, rather than the "chemical" smell that is often found when perchloroethylene or other non-aqueous solvents are used.

Perhaps the most widely practiced aqueous laundering process is that which the consumer performs when she or he immerses a garment into an aqueous laundry detergent solution in a conventional home washing machine. Such a process has long been shown to provide excellent performance for both stain removal and overall garment cleaning and can be performed without using hazardous or toxic chemicals. Moreover, the use of an aqueous laundering process in a conventional washing machine is considerably more convenient and inexpensive than virtually any other laundering method.

Nonetheless, such processes can produce unacceptable results when applied to a broad range of delicate or dry-clean only garments, such as those made from wool. Wool, is made up of fibers which can interlock with one another by a series of "scales". Generally, these interlocking scales cannot move past one another and as a result wool is a relatively strong textile. However, when wool becomes wet or moistened, the fibers move together, and the wool garment shrinks. This shrinkage cannot be undone because these "scales" can only move past one another in a preferred direction. Sufficient force cannot be exerted to move them in the direction opposite to the preferred direction to undo the shrinkage. Thus when the wool garment is removed from the aqueous laundry process, shrinkage has occurred and the garment is irreversibly damaged. Similarly, rayon, when saturated with water, becomes extremely weak and the subsequent agitation and abrasion that it experiences in a typical aqueous laundry process is likely not only to cause severe damage to the garment but also to leave it extremely wrinkled. Similarly, delicate fabrics like silk will not only be severely wrinkled but also may lose their desirable soft feel.

Garments such as silks are also vulnerable not only to the mechanical agitation of a conventional washing machine but are also particularly vulnerable to the typical laundry detergents because such detergents may contain ingredients that are too harsh for such delicate fabrics. It is thus desirable to provide an aqueous laundering process adapted for use in a conventional washing machine that is not harmful to garments made from fabrics such as wool, leather, suede, rayon, silk, acrylics, triacetates, fine cottons and blends of these aforementioned materials.

Therefore, a need exists for a process for laundering delicate or dry-clean only garments in a washing machine without the deleterious consequences described above. A need also exists for a convenient, inexpensive, and efficacious way to clean delicate and dry-clean only garments in the home.

SUMMARY OF THE INVENTION

The present invention solves the long-standing need for an inexpensive and convenient process of cleaning dry-clean only and other delicate garments in an aqueous laundering process, such as a conventional home washing machine. Processes (or systems) and kits for performing these processes have been found by which delicate and dry-clean only garments can be cleaned and freshened in an aqueous laundering process without damaging the garments. The processes of the present invention are intended to provide at least equivalent cleaning of garments when compared to a commercial dry-cleaning establishment using perchloroethylene but without the use of hazardous chemicals or the deposition of chemical malodors on the garments.

The system uses cleaning compositions which are modified to be mild on delicate garments. In addition, in one non-limiting embodiment, the system uses a garment container which is preferably in the form of a flexible, pervious wrap. When a garment is secured within this container, the garment is buffered and cushioned from the force and stress caused by the washing machine agitator. The garment container also helps to minimize shrinkage of the garment. Without wishing to be bound to any particular theory, it is believed that garment shrinkage is minimized because the wrap maintains the garments in an unbunched condition, which can be thought of conceptually maintaining tension on the garments. The present invention may also utilize a wash pretreatment applicator which is used to distribute or spread a wash pretreatment composition across the surface of a stain. Several non-limiting examples of the various components of this system will now be described generally.

The cleaning compositions (e.g., detergent compositions), as discussed above, are modified to be mild on delicate garments. The cleaning compositions can be used for various purposes in the system, and can be used at different stages of the washing process. The purposes for the cleaning compositions, and the stages at which they are introduced include, but are not limited to as: a pretreatment step, including, but not limited to for treatment of stains; during the wash cycle as a main wash composition; and as a conditioner, such as a rinse cycle conditioner. The cleaning compositions can be introduced into the system individually, or in any suitable combinations. Suitable combinations include, but are not limited to: a combination in which the same composition is used for pretreatment and for cleaning in the main wash, with or without a separate conditioner; and, a separate pretreatment composition and a combination wash/conditioner composition.

The cleaning compositions may be in any suitable form, such as in the form of a liquid, a gel, a foam or mousse, a viscous liquid, a dry or wet impregnated sheet, or in less preferred embodiments, a powder. The cleaning compositions can be introduced into the washing process in any suitable manner. The following are some non-limiting manners in which the cleaning compositions can be introduced into the washing process. In one embodiment, the cleaning composition can be poured into the washing machine in the same manner as conventional detergents. In other embodiments, the compositions can be applied to the garments to be cleaned. The compositions can be applied directly to the garments to be cleaned, or indirectly to the garments, such as applying the compositions to another article that comes into close proximity or contact with the garments. For example, in one embodiment, the composition can be applied to an article, such as a dosing pad, which is placed inside of the flexible wrap container, and the flexible wrap container with the article inside can be placed in the washing machine together. There are a non-limiting number of variations of these embodiments. For example, the composition can be applied to a dosing pad, and the dosing pad can either be part of the flexible wrap container, or be placed in the flexible wrap container with the garments to be cleaned.

In one non-limiting embodiment of the system, a first composition, preferably a detergent composition, is used to pre-treat stains and to enhance cleaning efficacy on stains. The system may provide an applicator and, optionally a special stain-absorbent pad which the consumer may use to pretreat a stain before the garment is placed in the washing machine. In addition, the system makes use of a second composition, preferably a detergent composition which is a combination of both a cleaning composition and a conditioner to improve color fidelity, provide anti-wrinkling benefits and reduce fabric abrasion as well as providing other fabric care benefits. In one embodiment of such a system, the pretreatment composition comprises an anionic surfactant, a nonionic surfactant, and a solvatrope for improving the stability of the pretreatment composition under freezing/thawing conditions. The combination washing/conditioning composition in this embodiment comprises an anionic surfactant, a quaternary ammonium surfactant, a silicone softening agent, and optionally an emulsifier. Preferably, the anionic surfactant to quaternary ammonium surfactant weight ratio is from about 2:1 to about 6:1.

The garment container, such as the flexible wrap container is designed to contain and protect delicate or dry-clean only clothes from being subjected to the agitation action of a washing machine. In one non-limiting embodiment, the basic part of the flexible wrap container is a flexible rectangular panel constructed of an open weave material, such as polyester or nylon material, either of which may be coated, such as with an acrylic coating. The garment container preferably resists shrinkage of the garments contained therein such that the garments have a shrinkage ratio (% dimensional change) of less than or equal to about 15% (e.g., between about 0% and about 15%) over five wash cycles. The garment container preferably has a wetting effectiveness of the garments contained therein of between about 90% and about 100%, more preferably at least about 95%, and most preferably 100%.

In a preferred embodiment, the flexible wrap container additionally comprises a first and second flap attached along the right edge of the panel and along the left edge of the panel, respectively. The flaps may overlap each other to provide increased garment containment during use. The flexible wrap container may be provided with closure devices, such as one or more straps. If straps are provided, each strap is preferably equipped with a pair of fasteners. When the wrap is folded up according to the directions of use, the strap or straps may be tightened around the wrap and one or more fasteners engaged to hold the strap or straps in place so that the bag is secured and will not open up under normal agitation conditions. Other preferred flexible wrap containers are provided with a tapering top portion to which is attached at least one of the previously described straps to further aid in containment of the garment. In a version of these embodiments, optionally at least two and preferably four snaps are located near the edge of one of the panel's sides or ends. These snaps may be used for attaching the flexible wrap container to another identical flexible wrap container to increase the capacity of the flexible wrap container, or to permit larger size garments to be placed therein.

The wash pretreatment applicator can be of any suitable configuration. Several preferred wash pretreatment applicators are disclosed. In one non-limiting embodiment, the wash pretreatment applicator is a substantially cylindrical tube having a closed end portion with numerous bristles adapted to fit on a wearer's finger and apply a cleaning composition to a stain covering a localized area of a delicate or dry-clean only garment. In another non-limiting embodiment, the wash pretreatment applicator comprises a pressure operated applicator. The pressure operated applicator preferably comprises a dabbing-type applicator comprising an applicator pad, a valve, and a container for the wash pretreatment composition. In a preferred version of this embodiment, the applicator pad is a novel structure comprising multiple layers of a net material.

The present invention also provides a kit for laundering delicate or dry-clean only garments in a washing machine, such as a conventional home washing machine. The kit comes with a flexible wrap container, one or more cleaning compositions, and instructions for using the container to launder garments in a washing machine. The process of the present invention can also be used in other types of washing machines, including commercial washing machines. The instructions provided are enclosed with or on a container enclosing the kit.

A non-limiting number of additional embodiments and features of the present invention are also possible. These embodiments and features may constitute inventions in their own right. In addition, the novel embodiments and features described herein can be combined in other manners, such as with prior compositions to provide still other novel systems and methods.

It is desirable that the methods described herein be suitable for use in the various types of washing machines in use throughout the world. These methods may, therefore have adaptations that make them more suitable for use in the following: high agitation top loading vertical axis washing machines such as those used in the United States; the longer wash cycle, higher water temperature horizontal axis front loading washing machines used in Europe; the relatively mild agitation/short wash cycle washing machines used in Japan; and, other types of washing machines used elsewhere. In one example of such an embodiment, a suitable retaining device can be used to maintain the wrap in a particular position in the tub of the washing machine.

DETAILED DESCRIPTION OF THE INVENTION

Figure 1:
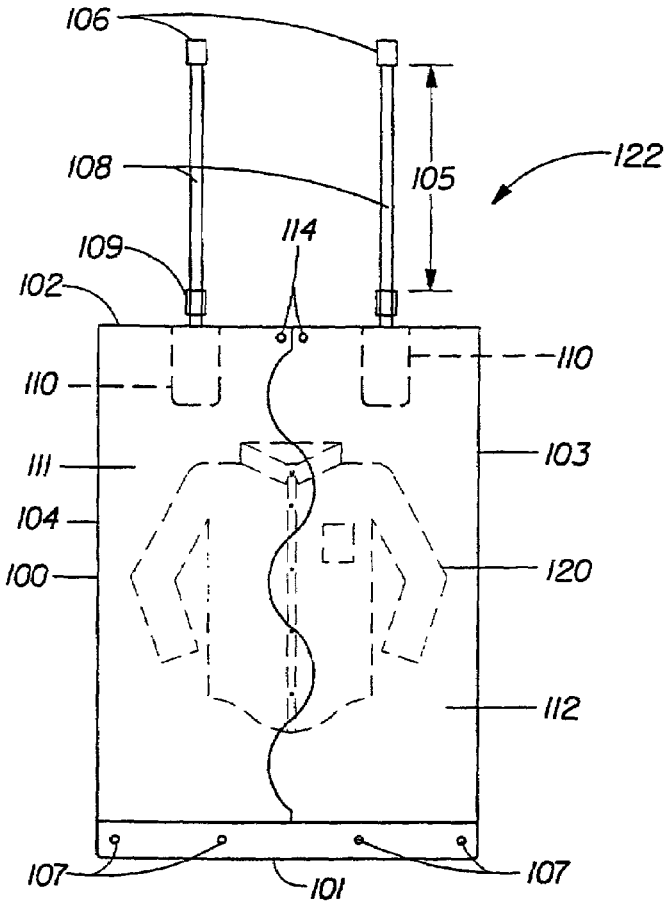
FIG. 1 is a side view illustrating the flexible wrap container 122.

Reference will now be made in detail to the present preferred embodiments of the invention, non-limiting examples of which are illustrated in the accompanying drawings.

The present invention relates to processes (or systems), compositions, articles, and kits by which delicate and dry-clean only garments can be cleaned and freshened in an aqueous laundering process without damaging the garment. The processes of the present invention are intended to provide at least equivalent cleaning of garments when compared to a commercial dry-cleaning establishment using perchloroethylene but without the use of hazardous chemicals or the deposition of chemical malodors on the garment.

These systems use cleaning compositions which are modified to be mild on delicate garments. In addition, in one non-limiting embodiment, the systems use a garment container, which is preferably in the form of a flexible, pervious wrap. When a garment is secured within this container, the garment is buffered and cushioned from the force and stress caused by the washing machine. The garment container also helps to control shrinkage of the garment. The present invention may also utilize a wash pretreatment applicator which is used to distribute or spread the wash pretreatment composition across the surface of a stain. Definitions that are applicable to the present description are as follows.

Definitions

By "aqueous compositions" herein is meant compositions which comprise a major portion of water.

By "solution" herein is meant a liquid mixture of ingredients. As used herein "solution" does not convey or imply the existence of only a single liquid or solid phase. Nor is it meant to describe a homogenous solvent/solute system.

By "effective amount" herein is meant any amount capable of measurably improving stain removal from a localized area of a garment. In general, this amount may vary quite widely.

By "cleaning" herein is meant the removal of soils and stains from fabrics. By "contact with stained areas" with respect to the wash pretreatment applicators is meant contact which is afforded by the applicator portion of the device with the one side of the stained area. By "contact with the stained areas" with respect to the absorbent stain receiver pad is meant that the side of the stained area of the fabric opposite the wash pretreatment applicator directly contacts the receiver pad and is in close communication therewith. Thick garments may require a modified process (e.g., the stain will be removed from the same side that the pretreatment applicator contacts.

All percentages, ratios and proportions herein are by weight, unless otherwise specified.

The components of the processes or systems of this invention and kits for performing these processes and their method of use are described in more detail hereinafter.

The Cleaning Compositions

Some laundry detergent compositions are too harsh to treat delicate and dry-clean only garments. In particular, detergent ingredients such as certain surfactants, certain enzymes and bleaches can cause serious damage (garment discoloration in particular) to delicate and dry-clean only garments. Accordingly, the cleaning compositions used herein, should most preferably be substantially free of bleaches and include an enzyme cocktail that is less harsh than the enzymes typically used in a laundry detergent composition. Stated otherwise, the cleaning compositions herein should be formulated so as not to damage fabrics by causing discoloration, abrasion or other adverse effects.

Consequently, while conventional laundry detergents are usually formulated to provide good cleaning on cotton and cotton/polyester blend fabrics, the compositions here must be formulated to also safely and effectively clean and refresh fabrics such as wool, leather, suede, silk, rayon, alpaca fleece, fine cotton and blends of the aforementioned fabrics. In addition, the compositions herein comprise ingredients which are specially selected and formulated to minimize the migration of fugitive dyes.

The cleaning compositions may be in any suitable form, such as in the form of a liquid, a gel, a foam or mousse, a viscous liquid, a dry or wet impregnated sheet, or in less preferred embodiments, a powder.

The cleaning compositions can be used for various purposes in the system, and can be used at different stages of the washing process. The purposes for the cleaning compositions, and the stages at which they are introduced include, but are not limited to as: a pretreatment step, including, but not limited to for treatment of stains; during the wash cycle as a main wash composition; and as a conditioner, such as a rinse cycle conditioner. The cleaning compositions can be introduced into the system individually, or in any suitable combinations. Suitable combinations include, but are not limited to: a combination in which the same composition is used for pretreatment and for cleaning in the main wash, with or without a separate conditioner; and, a separate pretreatment composition and a combination wash/conditioner composition.

In one non-limiting embodiment, the present invention includes both a wash pretreatment composition and a combination washing/conditioning composition—the latter providing both detersive-cleaning benefits and conditioning and softening benefits in a single composition. The processes of the present invention will be described in terms of this embodiment, but it is to be understood that this description is by way of example, rather than being limiting. For example, other cleaning composition systems (including, but not limited to the liquid cleaning composition and rinse cycle conditioner described in PCT Publication WO 00/24958, Curry, et al., published May 4, 2000, which claims priority to the following U.S. patent application: No. 60/105,539, filed Oct. 24, 1998 and 60/157,399, filed Oct. 1, 1999) can be used with the improved flexible wrap container described herein, and benefits will still be achieved.

It has been discovered that when the applicator and the wash pretreatment composition are used in the manner described herein, excellent spot and stain removal performance is obtained even though these detergent compositions are specially formulated to be mild and gentle. In addition to the foregoing considerations, the wash pretreatment composition used herein is preferably formulated such that it is easily dispensed and not so viscous in nature that it renders the stain-removal applicator unwieldy or difficult to use.

The following are intended only to be non-limiting illustrations of such compositions, more examples of which will readily come to mind of the skilled formulator.

The Wash Pretreatment Composition

The wash pretreatment composition is an optional component of the present invention and may be selected from the following suitable ingredients which will now be discussed in seritam.

Detersive Surfactants—Surfactants are known to have potentially harsh effects on fabrics. Typically, the compositions herein will comprise from about 3% to about 40%, more preferably from about 10% to about 25%, most preferably from about 15% to about 20%, by weight of detersive surfactants.

Nonlimiting examples of surfactants useful herein include the unsaturated sulfates such as oleyl sulfate, the $C_{10}$–$C_{18}$ alkyl alkoxy sulfates ("$AE_xS$"; especially EO 1-7 ethoxy sulfates), $C_{10}$–$C_{18}$ alkyl alkoxy carboxylates (especially the EO 1-5 ethoxycarboxylates), and primary, branched-chain and random $C_{10}$–$C_{20}$ alkyl sulfates ("AS"), the $C_{10}$–$C_{18}$ secondary (2,3) alkyl sulfates of the formula $CH_3(CH_2)_x(CHOSO_3^-M^+)$ $CH_3$ and $CH_3$ $(CH_2)_y(CHOSO_3^-M^+)$ $CH_2CH_3$ where x and (y+1) are integers of at least about 7, preferably at least about 9, and M is a water-solubilizing cation, especially sodium, the $C_{10-18}$ glycerol ethers, the $C_{10}$–$C_{18}$ alkyl polyglycosides and their corresponding sulfated polyglycosides, and $C_{12}$–$C_{18}$ alpha-sulfonated fatty acid esters. If desired, the conventional nonionic and amphoteric surfactants such as the $C_{12}$–$C_{18}$ alkyl ethoxylates ("AE") including the so-called narrow peaked alkyl ethoxylates and $C_6$–$C_{12}$ alkyl phenol alkoxylates (especially ethoxylates and mixed ethoxy/propoxy), $C_{12}$–$C_{18}$ betaines and sulfobetaines ("sultaines"), $C_{10}$–$C_{18}$ amine oxides, and the like, can also be included in the overall compositions. The $C_{10}$–$C_{18}$ N-alkyl polyhydroxy fatty acid amides can also be used. Typical examples include the $C_{12}$–$C_{18}$ N-methylglucamides. See PCT Publication WO 92/06154 A1. Other sugar-derived surfactants include the N-alkoxy polyhydroxy fatty acid amides, such as $C_{10}$–$C_{18}$ N-(3-methoxypropyl) glucamide. The N-propyl through N-hexyl $C_{12}$–$C_{18}$ glucamides can be used for low sudsing. $C_{10}$–$C_{20}$ conventional soaps may also be used. If high sudsing is desired, the branched-chain $C_{10}$–$C_{16}$ soaps may be used. Mixtures of anionic and nonionic surfactants are especially useful and cationic and amphoteric surfactants may also be used. Other conventional useful surfactants are listed in standard texts.

Builders—The compositions herein preferably comprise one or more detergent builders or builder systems. When present, the compositions will typically comprise from about 0.01% to about 35%, more preferably from about 1% to about 25%, most preferably from about 2% to about 8% by weight, of detergent builder.

Organic detergent builders suitable for the purposes of the present invention include, but are not restricted to, a wide variety of polycarboxylate compounds. As used herein, "polycarboxylate" refers to compounds having a plurality of carboxylate groups, preferably at least 3 carboxylates. Polycarboxylate builder can generally be added to the composition in acid form, but can also be added in the form of a neutralized salt. When utilized in salt form, alkali metals, such as sodium, potassium, and lithium, or alkanolammonium salts are preferred.

Citrate builders, e.g., citric acid and soluble salts thereof (particularly sodium salt), are polycarboxylate builders of particular importance for the present detergent formulations due to their availability from renewable resources and their biodegradability.

Included among the polycarboxylate builders are a variety of categories of useful materials. One important category of polycarboxylate builders encompasses the ether polycarboxylates, including oxydisuccinate, as disclosed in U.S. Pat. No. 3,128,287 Berg, issued Apr. 7, 1964, and U.S. Pat. No. 3,635,830 Lamberti et al., issued Jan. 18, 1972. See also "TMS/TDS" builders of U.S. Pat. No. 4,663,071 Bush et al., issued May 5, 1987. Suitable ether polycarboxylates also include cyclic compounds, particularly alicyclic compounds, such as those described in U.S. Pat. No. 3,923,679 Rapko, issued Dec. 2, 1975; U.S. Pat. No. 4,158,635 Crutchfield et al., issued Jun. 19, 1979; U.S. Pat. No. 4,120,874 Crutchfield et al., issued Oct. 17,1978; and U.S. Pat. No. 4,102,903 Crutchfield et al., issued Jul. 25, 1978.

Other useful detergency builders include the ether hydroxypolycarboxylates, copolymers of maleic anhydride with ethylene or vinyl methyl ether, 1,3,5-trihydroxy benzene-2,4,6-trisulphonic acid, and carboxymethyloxysuccinic acid, the various alkali metal, ammonium and substituted ammonium salts of polyacetic acids such as ethylenediamine tetraacetic acid and nitrilotriacetic acid, as well as polycarboxylates such as mellitic acid, succinic acid, oxy-disuccinic acid, polymaleic acid, benzene 1,3,5-tricarboxylic acid, carboxymethyloxysuccinic acid, and soluble salts thereof.

Other suitable polycarboxylates are disclosed in U.S. Pat. No. 4,144,226, Crutchfield et al., issued Mar. 13, 1979 and in U.S. Pat. No. 3,308,067, Diehl, issued Mar. 7, 1967. See also Diehl U.S. Pat. No. 3,723,322.

Enzymes—Enzymes can be included in the formulations herein for a wide variety of fabric laundering purposes, including removal of protein-based, carbohydrate-based, or triglyceride-based stains; for the prevention of fugitive dye transfer. Certain enzymes also provide fabric restorative benefits by decomposing and degrading the loose and frayed fibers on the surface of a textile article, particularly textile articles made from silk or wool.

The enzymes to be incorporated include proteases, amylases, lipases, and mannanases, as well as mixtures thereof. Other types of enzymes may also be included. They may be of any suitable origin, such as vegetable, animal, bacterial, fungal and yeast origin. However, their choice is governed by several factors such as pH-activity and/or stability optima, thermostability, stability versus surfactants, builders and so on. Protease is an acceptable enzyme because of its well-known cleaning benefits on a variety of organic-material stains, but it should be chosen to not adversely effect wool and silk at the conditions used. Enzymes such as cellulases and peroxidases are less desirable because of their potentially harsh effects on delicate garments and in an optimal composition, they are not present.

Enzymes are normally incorporated at levels sufficient to provide up to about 5 mg by weight, more typically about 0.01 mg to about 3 mg, of active enzyme per gram of the composition. Stated otherwise, the compositions herein will typically comprise from about 0.001% to about 5%, preferably 0.01%–1.0% by weight of a commercial enzyme preparation. Protease enzymes are usually present in such commercial preparations at levels sufficient to provide from 0.005 to 0.1 Anson units (AU) of activity per gram of composition.

Further examples of enzymes suitable for use in the present invention can be found in the copending provisional application of Boutique et al., entitled "Detergent Compositions Comprising Improved Hydrotropes," P&G Case No. 7694P2, Ser. No. 60/150,233, having been filed on Aug. 23, 1999.

Enzyme Stabilizing System—The compositions herein may comprise from about 0.001% to about 10%, preferably from about 0.005% to about 8%, most preferably from about 0.01% to about 6%, by weight of an enzyme stabilizing system. The enzyme stabilizing system can be any stabilizing system which is compatible with the detersive enzyme. Such a system may be inherently provided by other formulation actives, or be added separately, e.g., by the formulator or by a manufacturer of detergent-ready enzymes. Such stabilizing systems can, for example, comprise calcium ion, boric acid, propylene glycol, short chain carboxylic acids, boronic acids, and mixtures thereof, and are designed to address different stabilization problems depending on the type and physical form of the detergent composition.

One possible stabilizing approach is by use of borate species. See Severson, U.S. Pat. No. 4,537,706. Borate stabilizers, when used, may be at levels of up to 10% or more of the composition though more typically, levels of up to about 3% by weight of boric acid or other borate compounds such as borax or orthoborate are suitable for liquid detergent use. Substituted boric acids such as phenylboronic acid, butaneboronic acid, p-bromophenylboronic acid or the like can be used in place of boric acid and reduced levels of total boron in detergent compositions may be possible though the use of such substituted boron derivatives.

Stabilizing systems of certain cleaning compositions may further comprise from 0% to about 10%, preferably from about 0.01% to about 6% by weight, of chlorine bleach scavengers, added to prevent chlorine bleach species present in many water supplies from attacking and inactivating the enzymes, especially under alkaline conditions. While chlorine levels in water may be small, typically in the range from about 0.5 ppm to about 1.75 ppm, the available chlorine in the total volume of water that comes in contact with the enzyme, for example during fabric washing, can be relatively large; accordingly, enzyme stability to chlorine in-use is sometimes problematic. Suitable chlorine scavenger anions are widely known and readily available, and, if used, can be salts containing ammonium cations with sulfite, bisulfite, thiosulfite, thiosulfate, iodide, etc. Antioxidants such as carbamate, ascorbate, etc., organic amines such as ethylenediaminetetracetic acid (EDTA) or alkali metal salt thereof, monoethanolamine (MEA), and mixtures thereof can likewise be used.

The compositions herein may contain any of the water-soluble formates described in U.S. Pat. No. 4,318,818, Letton et al, issued Mar. 9, 1982, incorporated herein by reference. Formate is present at a level of from about 0.05% to about 5%, preferably from about 0.05% to about 2%, most preferably from about 0.05% to about 1.5%, by weight of the composition.

Other suitable detergent ingredients that can be added as enzyme stabilizers are the enzyme oxidation scavengers which are described in copending European Patent application 92870018.6 filed on Jan. 31, 1992. Examples of such enzyme oxidation scavengers are ethoxylated tetraethylene polyamines.

Further compounds and techniques suitable for enzyme stabilization and chlorine scavenging for use in the present invention can be found in the copending provisional application of Curry et al., entitled "Methods for Laundering Delicate Garments in a Washing Machine," having P&G Case No. 7315P2, Ser. No. 60/157,399, filed Oct. 1, 1999.

Particulate Soil Removal/Anti-redeposition Agents—The compositions herein can also optionally contain water-soluble ethoxylated amines having particulate soil removal and antiredeposition properties. Liquid detergent compositions typically contain about 0.01% to about 5%.

The most preferred soil release and anti-redeposition agent is ethoxylated tetraethylene-pentamine ("TEPA"). On average tetraethylene-pentamine is ethoxylated with 15–18 moles of ethylene oxide at each hydrogen site. Exemplary ethoxylated amines are further described in U.S. Pat. No. 4,597,898, VanderMeer, issued Jul. 1, 1986. Another group of preferred particulate soil removal-antiredeposition agents are the cationic compounds disclosed in European Patent Application 111,965, Oh and Gosselink, published Jun. 27, 1984. Other particulate soil removal/antiredeposition agents which can be used include the ethoxylated amine polymers disclosed in European Patent Application 111,984, Gosselink, published Jun. 27, 1984; the zwitterionic polymers disclosed in European Patent Application 112,592, Gosselink, published Jul. 4, 1984; and the amine oxides disclosed in U.S. Pat. No. 4,548,744, Connor, issued Oct. 22, 1985. Other particulate soil removal and/or anti redeposition agents known in the art can also be utilized in the compositions herein. Another type of preferred antiredeposition agent includes the carboxy methyl cellulose (CMC) materials.

Dye Transfer Inhibiting Agents—An important part of the present invention is providing color care for delicate garments and fabrics which are cleaned according to the aqueous cleaning processes described herein. Thus, the compositions herein may also include one or more materials effective for inhibiting the transfer of dyes from one fabric to another during the cleaning process. Generally, such dye transfer inhibiting agents include polyvinyl pyrrolidone polymers, polyamine N-oxide polymers, copolymers of N-vinylpyrrolidone and N-vinylimidazole, manganese phthalocyanine, peroxidases, and mixtures thereof. If used, these agents typically comprise from about 0.01% to about 10% by weight of the composition, preferably from about 0.01% to about 5%, and more preferably from about 0.05% to about 2%.

More specifically, the polyamine N-oxide polymers preferred for use herein contain units having the following structural formula: R-$A_x$-P; wherein P is a polymerizable unit to which an N—O group can be attached or the N—O group can form part of the polymerizable unit or the N—O group can be attached to both units; A is one of the following structures: —NC(O)—, —C(O)O—, —S—, —O—, —N═; x is 0 or 1; and R is aliphatic, ethoxylated aliphatics, aromatics, heterocyclic or alicyclic groups or any combination thereof to which the nitrogen of the N—O group can be attached or the N—O group is part of these groups. Preferred polyamine N-oxides are those wherein R is a heterocyclic group such as pyridine, pyrrole, imidazole, pyrrolidine, piperidine and derivatives thereof.

The N—O group can be represented by the following general structures:

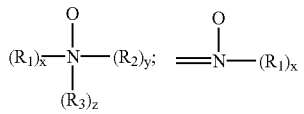

wherein $R_1$, $R_2$, $R_3$ are aliphatic, aromatic, heterocyclic or alicyclic groups or combinations thereof, x, y and z are 0 or 1; and the nitrogen of the N—O group can be attached or form part of any of the aforementioned groups. The amine oxide unit of the polyamine N-oxides has a pKa <10, preferably pKa <7, more preferred pKa <6.

An example of a dye transfer inhibiting agent is poly (4-vinylpyridine-N-oxide) which can be referred to as "PVNO" (but preferably this particular dye transfer inhibiting agent is only incorporated into the combination washing/conditioning composition). Also suitable are copolymers of N-vinylpyrrolidone and N-vinylimidazole polymers (referred to as a class as "PVPVI") as well as polyvinylpyrrolidone ("PVP"). These are discussed in greater detail in U.S. Pat. No. 5,759,208, to Zhen et al., issued Jun. 2, 1998, which is hereby incorporated by reference.

Additional Color Care Agents—In addition to the dye transfer inhibitors, the present invention further comprises an additional agent to provide color care benefits: 30 polyethyleneimine, PEI 600 E20, having the general formula:

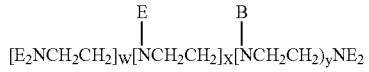

wherein B is a continuation by branching of the polyethyleneimine backbone. E is an ethyleneoxy unit having the formula:

$$—(CH_2CH_2O)mH$$

wherein m has an average value of about 20. What is meant herein by an average value of 20 is that sufficient ethylene oxide or other suitable reagent is reacted with the polyethyleneimine starting material to fully ethoxylate each N—H unit to a degree of 20 ethoxylations. However, those skilled in the art will realize that some N—H unit hydrogen atoms will be replaced by less than 20 ethoxy units and some will be replaced by more than 20 ethoxy units, therefore, the average of the number of ethoxylations is 20.

The units which make up the polyalkyleneimine backbones are primary amine units having the formula:

$$H_2N—CH_2CH_2]— \text{ and } —NH_2$$

which terminate the main backbone and any branching chains, secondary amine units having the formula:

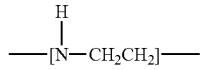

and which, after modification, have their hydrogen atom substituted by an average of 20 ethyleneoxy units, and tertiary amine units having the formula:

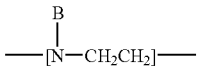

which are the branching points of the main and secondary backbone chains, B representing a continuation of the chain structure by branching. The tertiary units have no replaceable hydrogen atom and are therefore not modified by substitution with ethyleneoxy units. During the formation of the polyamine backbones, cyclization may occur, therefore, an amount of cyclic polyamine can be present in the parent polyalkyleneimine backbone mixture. Each primary and secondary amine unit of the cyclic alkyleneimines undergoes modification by the addition of alkyleneoxy units in the same manner as linear and branched polyalkyleneimines.

The indices w, x, and y have values such that the average molecular weight of the polyethyleneimine backbone prior to modification is about 600 daltons. In addition, those skilled in the art will recognize that each branch chain must terminate in a primary amine unit, therefore the value of the index w is y+1 in the case where no cyclic amine backbones are present.

The polyamines useful herein can be prepared, for example, by polymerizing ethyleneimine in the presence of a catalyst such as carbon dioxide, sodium bisulfite, sulfuric acid, hydrogen peroxide, hydrochloric acid, acetic acid, etc. Specific methods for preparing these polyamine backbones are disclosed in U.S. Pat. No. 2,182,306, Ulrich et al., issued Dec. 5, 1939; U.S. Pat. No. 3,033,746, Mayle et al., issued May 8, 1962; U.S. Pat. No. 2,208,095, Esselmann et al., issued Jul. 16, 1940; U.S. Pat. No. 2,806,839, Crowther, issued Sep. 17, 1957; and U.S. Pat. No. 2,553,696, Wilson, issued May 21, 1951; all herein incorporated by reference.

Stabilization Agents

The presence of certain surfactants may reduce the phase stability of the formulation especially at low temperature and under freezing/thawing conditions. Preferably, at least one stabilization agent, such as a solvatrope, is added to the formulation to achieve desirable phase stability in a complex surfactant system. It is highly desirable for the composition to become homogenous after thawing, rather than remaining a blob or a thick gel.

The term "solvatrope", as used herein, refers to a solvent that exhibits behavior like that of a hydrotrope. Hydrotropes are described in *The Aqueous Phase Behavior of Suractants*, Robert G. Laughlin, Academic Press, Inc., San Diego, Calif. USA. In other words, the solvatrope exhibits a behavior that is between that of a surfactant and a solvent. The chain length of the solvatrope's tail group is not large enough to be a surfactant and a solvatrope would not form micelles. Normally, a $C_8$ tail, as opposed to a $C_6$ tail, is needed for weak surfactant behavior. The solvatrope will, however, mix with a surfactant to improve its solubility, and the solvatrope's head group is small enough to be able to act as a solvent.

Without wishing to be bound to any particular theory, the solvatrope is believed to increase the solubility or the degree of miscibility between the various surfactant phases present in the formulation. This lowers the coefficient of friction while maintaining a strong interaction which allows the formulation of stable low viscosity formulations of complex surfactant systems. These additives also allow the use of ingredients that would otherwise increase the apparent viscosity of the formula and negatively affect the spreading, diffusion and dissolution properties. Good spreading properties are important in direct contact pre-treat applications. Diffusion and dissolution are important for the cleaning of delicate garments.

Again, without wishing to be bound to any particular theory, it is believed that solvatropes, probably due to their double OH functionality combined with a medium length carbon chain length, modify the phase to phase interactions, but differently from the behavior of a typical solvent, these solvatropes modify these interactions without completely eliminating them. This results in a lower viscosity product that due to the presence of some phase to phase interaction still maintain good stability properties. Solvatropes act as coupling agents between the nonionic or cationic surfactant and water phases that typically avoid to coexist homogeneously or tend to gel. With the addition of solvatropes a single phase is delivered that is bicontinuous in nature. This phase incorporates a domain containing the surfactant and solvatrope and a domain containing the water. Some solvatropes can exist in the water containing domain. The solvatropes may have the following characteristics; 1) ClogP between about 0.1—about 0.6, or slightly higher (ClogP is the partitioning coefficient of a material between water and octanol), 2) some degree of polarity (no center of symmetry). The "calculated logP" (ClogP) is determined by the fragment approach of Hansch and Leo (cf., A. Leo, in Comprehensive Medicinal Chemistry, Vol. 4, C. Hansch, P. G. Sammens, J. B. Taylor and C. A. Ramsden, Eds., p. 295, Pergamon Press, 1990, incorporated herein by reference).

This allows the formulation of low viscosity (50–100 cps) liquids that are phase stable while containing complex mixed surfactant system. Formulations with these solvatropes are more stable at low temperatures and at freeze thaw conditions (i.e., especially when tested in cycle tests between 0 to 30° F.).

Many solvatropes may be used among them, 2,2,4-trimethyl-1,3-pentanediol (TMPD), 1,2-hexanediol, 2-ethyl-1,3-hexanediol (EHD). Other compositions useful as solvatropes are the principal solvent materials, especially mono-ol and diol principal solvents, having a ClogP of from about 0.15 to about 0.64, described in U.S. patent application Ser. No. 08/983,542 (P&G Case 6009rx) entitled "Clear Fabric Softener Compositions Containing Biodegradable Active and Specific Mono-ols" filed in the name of Trinh, et al. (PCT Publication No. WO 97/03169, published Jan. 30, 1997). It is believed that $C_5$–$C_{10}$ diols may also be useful herein. In addition, this publication contains a listing of derivatives of diols that can also be used as principal solvents.

Other materials which are suitable for use as solvatropes are ethoxylated TMPD, 1,4 cyclohexanedimethanol as described in the following Witco Corporation patents: U.S. Pat. No. 5,674,832 entitled "Cationic Compositions Containing Diol and/or Diol Alkoxylate" issued in the name of Keys on Oct. 7, 1997; U.S. Pat. No. 5,686,023 entitled "$C_7$–$C_{12}$ Diol and Diol Alkoxylates as Coupling Agents for Surfactant Formulations" issued in the name of Keys on Nov. 11, 1997; and U.S. Pat. No. 5,753,079 entitled "Obtaining Enhanced Paper Production Using Cationic Compositions Containing Diol and/or Diol Alkoxylate" issued in the name of Jenny, et al. on May 19, 1998; and in U.S. Pat. No. 5,824,635 entitled "Cationic Compositions Containing Hydroxyester" issued in the name of Keys on Oct. 20, 1998. Finally, there is another solvatrope, ethoxylated phenol described in EP Patent Publication 1018541 A1 entitled "Clear Fabric Softener Compositions" published in the name of Fender, et al. by Goldschmidt Rewo GmbH & Co. that can be used.

In one embodiment, the solvatrope is a mixture of 2,2,4-trimethyl-1,3-pentanediol and 1,4-cyclohexanedimethanol in a weight ratio of from about 80:20 to about 50:50, more preferably in a weight ratio of about 75:25.

The use of co-solvatropes can also be effective, such as 1,4-cyclohexane dimethanol (CHDM), alcohol ethoxylate ($C_9$–$C_{11}$ EO5), and other nonionic materials.

High levels of electrolytes, e.g., 1.5% to 3% $CaCl_2$ or $MgCl_2$, allow the use of much broader range of solvatropes (widened the Clog P range) and allow the use of a lower level of solvatrope. For example, hexylene glycol can be used which is relatively inexpensive and available in the market.

Other Components—Other optional ingredients for the compositions herein include but are not limited to: fatty acid carboxylate builders, suds suppressors, including silicone suds suppressors, hydrotropes, antibacterial agents, additional enzyme stabilizers and perfumes. Especially desirable are fabric color protection agents. The pH of the composition as disclosed here is preferably between about 5 and about 9.

Application of the Wash Pretreatment Composition to the Garments

The wash pretreatment composition is preferably distributed over the surface of a stained area of the garment by the use of an applicator (described in greater detail herein) after which the stained area of the garment is optionally rinsed off with water.

The Combination Washing/Conditioning Composition

The present invention also relates to a washing/conditioning composition which provides not only detersive and cleaning benefits on dry-clean only garments but preferably also through-the-wash softening and conditioning. This greatly enhances the convenience of the overall process to the consumer because the conditioning agent is added at the beginning of the wash cycle and does not need to be added subsequently during the rinse cycle. In addition to its cleaning benefits, the combination washing/conditioning solution provides a number of important benefits: such as improved color fidelity, improved abrasion resistance and excessive wrinkling prevention. Fabric softeners also help maintain fabric softness of garments such as silk, which can have a rough feel after being washed in an aqueous laundry detergent. Thus particularly important for the present combination washing/conditioning composition are additives which act as anti-shrinkage agents, anti-wrinkle agents, anti-abrasion agents, fabric crisping agents and other fabric color protection agents.

Many of the ingredients for one embodiment of the washing/conditioning composition have been described above in the section on the wash pretreatment composition and will not be duplicated here. In addition to those ingredients, the following optional and essential ingredients will be selected by the skilled formulator for use in the washing/conditioning composition. Still further ingredients suitable for use in the present invention are further disclosed in U.S. Pat. No. 5,460,736, Trinh et al., issued Oct. 24, 1995; U.S. Pat. No. 5,545,350, Baker et al., issued Aug. 13, 1996; U.S. Pat. No. 5,562,849, Wahl et al., issued Oct. 8, 1996; all of which are hereby incorporated by reference.

Quaternary Ammonium Surfactants—As an essential component, the combination washing/conditioning compositions herein preferably contain from about 1% to about 10%, preferably from about 2% to about 7%, more preferably from about 3% to about 5% by weight of a quaternary ammonium surfactant of the formula:

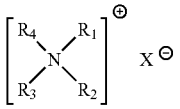

wherein $R_1$ and $R_2$ are individually selected from the group consisting of $C_1$–$C_4$ alkyl, $C_1$–$C_4$ hydroxy alkyl, benzyl, and —$(C_2H_4O)_xH$ where x has a value from about 2 to about 5; X is an anion; and (1) $R_3$ and $R_4$ are each a $C_6$–$C_{14}$ alkyl or (2) $R_3$ is a $C_6$–$C_{18}$ alkyl, and $R_4$ is selected from the group consisting of $C_1$–$C_{10}$ alkyl, $C_1$–$C_{10}$ hydroxyalkyl, benzyl, and —$(C_2H_4O)_xH$ where x has a value from 2 to 5.

Preferred quaternary ammonium surfactants are the chloride, bromide, and methylsulfate salts. Examples of preferred mono-long chain alkyl quaternary ammonium surfactants are those wherein $R_1$, $R_2$, and $R_4$ are each methyl and $R_3$ is a $C_8$–$C_{16}$ alkyl; or wherein $R_3$ is $C_8$–$C_{18}$ alkyl and $R_1$, $R_2$, and $R_4$ are selected from methyl and hydroxyalkyl moieties. Lauryl trimethyl ammonium chloride, myristyl trimethyl ammonium chloride, palmityl trimethyl ammonium chloride, coconut trimethylammonium chloride, coconut trimethylammonium methylsulfate, coconut dimethyl-monohydroxy-ethylammonium chloride, coconut dimethyl-monohydroxyethylammonium methylsulfate, stearyl dimethyl-monohydroxy-ethylammonium chloride, stearyl dimethyl-monohydroxyethylammonium methylsulfate, di-$C_{12}$–$C_{14}$ alkyl dimethyl ammonium chloride, and mixtures thereof are particularly preferred.

Ratio of Anionic Surfactants to Quaternary Ammonium Surfactants—Anionic surfactants and quaternary ammonium surfactants are both essential components of the present invention. When they are present together within a certain weight ratio they form a mixed micellar system within the composition so that while the washing/conditioning composition is sufficiently viscous to suspend silicone softening agent emulsions and other polymers, the compositions are simultaneously not so viscous and thick that they cannot be easily and conveniently poured out of a detergent bottle in which they are contained.

In order to achieve the optimum balance of phase stability/suspension benefits and product viscosity it is preferable that the weight ratio of anionic surfactants to quaternary ammonium surfactants be from about 2:1 to about 5:1 or 6:1, preferably from about 2.2:1 to about 5.5:1.

In a preferred embodiment, the formulation comprises 14.4% AE1.1S (alkyl alkoxy sulfates), 3% $C_{12}$ trimethyl ammonium chloride (lauryl trimethyl ammonium chloride, a cationic surfactant) (anionic/cationic ratio=4.8:1), and 3% trimethylpentanediol. This embodiment delivers a stable product with AE1.1S anionic surfactant under a wide range of temperature conditions. This formulation is phase stable at temperatures ranging from 40° F. to 120° F. for over four months, and avoids crystallization at low temperatures. Improved stability is achieved without decreasing the cleaning, color care, garment wetting, suds reduction, or ease-of-ironing benefits of the system.

Enzymes—As discussed above, enzymes enhance cleaning and removal on a wide variety of stains, including protein-based, carbohydrate-based, or triglyceride-based stains. In the present combination washing/conditioning compositions, certain enzymes also provide fabric restorative benefits by decomposing and degrading the loose and frayed fibers on the surface of a textile article, particularly textile articles made from silk or wool. Mannanase enzymes and amylase enzymes are also preferred for use in the washing/cleaning compositions because of their stain removal benefits. As mentioned above, enzymes such as cellulases and peroxidases are less desirable.

A particularly preferred amylase enzyme is NATALASE® which can be specified as an a-amylase having a specific activity at least 25% higher than the specific activity of Termamylâ at a temperature range of 25° C. to 55° C. and at a pH value in the range of 8 to 10, measured by the Phadebasâ α-amylase activity assay.

Silicone Softening Agents and Emulsions thereof—The combination washing/conditioning composition may also include a variety of silicone oils (preferably prepared in the form of an emulsion) which have been discovered to impart a significantly smoother feel to most types of fabrics and also significantly reduce the amount of wrinkle formation. The silicone softening agent may or may not be present in the form of an emulsion.

Silicone softening agents include polyalkyl or polyaryl siloxanes which conform to the following formula

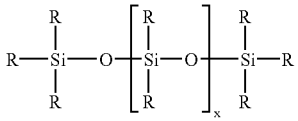

where R is aliphatic, preferably alkyl or alkenyl, or aryl, R can be substituted or unsubstituted, and x is an integer from 1 to about 8,000. Suitable unsubstituted R groups include alkoxy, aryloxy, arylalkyl, arylalkenyl, alkylamine, and ether-substituted, hydroxyl-substituted, and halogen-substituted aliphatic and aryl groups. Suitable R groups also include cationic amines and quaternary ammonium groups.

The aliphatic or aryl groups substituted on the siloxane chain may have any structure so long as the resulting silicones remain fluid at room temperature, are hydrophobic, are neither damaging or otherwise harmful when applied to textile articles, are compatible with the other components of the detergent composition, are chemically stable under normal use and storage conditions and are capable of being deposited on and conditioning textile articles according to the methods outlined in the present invention.

The two R groups on the silicon atom of each monomeric silicone unit may represent the same or different groups. Preferably, the two R groups represent the same group.

Preferred alkyl and alkenyl substituents are $C_1$–$C_5$ alkyls and alkenyls, more preferably from $C_1$–$C_4$, most preferably from $C_1$–$C_2$. The aliphatic portions of other alkyl-, alkenyl-, or alkynyl-containing groups (such as alkoxy, arylalkyl, and alkylamino) can be straight or branched chains and preferably have from one to five carbon atoms, more preferably from one to four carbon atoms, even more preferably from one to three carbon atoms, most preferably from one to two carbon atoms.

Further suitable R groups include methyl, ethyl, propyl, phenyl, methylphenyl and phenylmethyl. The preferred silicones are polydimethylsiloxane, polydiethylsiloxane, and polymethylphenylsiloxane. Polydimethylsiloxane is especially preferred. Other suitable R groups include methyl, methoxy, ethoxy, polyethoxy, propoxy, and aryloxy. The three R groups on the end caps of the silicone may also represent the same or different groups.

Other preferred silicones include nonionic polyalkylene oxide-modified polydimethylsiloxanes which are especially effective at wrinkle reduction. Such silicone fluids are available from the OSI Specialties Company under the name SILWET®. SILWET® L77, which is a mixture of 84% polyalkyleneoxide modified heptamethyltrisiloxane and 16% allyloxypolyethyleneglycol methyl ether, is particularly preferred.

Further discussion and examples of silicone oils suitable for use may be found in U.S. Pat. No. 5,874,073, to Kaiser et al., issued on Feb. 23, 1999, which is hereby incorporated by reference. It may be desirable to incorporate emulsifiers at concentrations effective for emulsifying the silicone conditioning agents. (As used herein, "emulsifiers" include suspending agents.) Emulsifiers and suspending agents are discussed in further detail in U.S. Pat. No. 5,874,073 and U.S. Pat. No. 5,759,208, both of which are incorporated above. Particularly preferred are emulsifying surfactants disclosed in U.S. Pat. No. 5,759,208, which are added to the silicone fluid to form an emulsion Cyclic amine Based Polymer, Oligomer or Copolymer Materials—It is preferred that the combination washing/conditioning composition comprises one or more cyclic amine based polymer, oligomer or copolymer. Such materials have been found to impart a number of appearance benefits to fabrics and textiles laundered in aqueous washing solutions formed from detergent compositions which contain a mixture of cyclic amine based polymers, oligomers or copolymers and hydrophobically modified cellulosic based polymers or oligomers fabric treatment materials. Such fabric appearance benefits can include, for example, improved overall appearance of the laundered fabrics, reduction of the formation of pills and fuzz, protection against color fading, improved abrasion resistance, etc. The cyclic amine based fabric treatment materials used in the compositions and methods herein can provide such fabric appearance benefits with acceptably little or no loss in cleaning performance provided by the laundry detergent compositions into which such materials are incorporated.

The cyclic amine based polymer, oligomer or copolymer component of the compositions herein may comprise combinations of these cyclic amine based materials. For example, a mixture of piperidine and epihalohydrin condensates can be combined with a mixture of morpholine and epihalohydrin condensates to achieve the desired fabric treatment results. Moreover, the molecular weight of cyclic amine based fabric treatment materials can vary within the mixture as is illustrated in the Examples below.

As will be apparent to those skilled in the art, an oligomer is a molecule consisting of only a few monomer units while polymers comprise considerably more monomer units. For the present invention, oligomers are defined as molecules having an average molecular weight below about 1,000 and polymers are molecules having an average molecular weight of greater than about 1,000. Copolymers are polymers or oligomers wherein two or more dissimilar monomers have been simultaneously or sequentially polymerized. Copolymers of the present invention can include, for example, polymers or oligomers polymerized from a mixture of a primary cyclic amine based monomer, e.g., piperidine, and a secondary cyclic amine monomer, e.g., morpholine.

The mixture of cyclic amine based polymers, oligomers or copolymers and hydrophobically modified cellulosic based polymers or oligomers of the detergent compositions herein will generally comprise from about 0.01% to about 5% by the weight of the detergent composition. More preferably, the mixture of cyclic amine based polymers, oligomers or copolymers and hydrophobically modified cellulosic based polymers or oligomers will comprise from about 0.1% to about 4% by weight of the detergent compositions, most preferably from about 0.5% to about 3%. However, as discussed above, when used as a washing solution additive, i.e. when mixture of cyclic amine based polymers, oligomers or copolymers and hydrophobically modified cellulosic based polymers or oligomers are not incorporated into a detergent composition, the concentration of mixture of cyclic amine based polymers, oligomers or copolymers and hydrophobically modified cellulosic based polymers or oligomers can comprise from about 0.1% to about 80% by weight of the additive material.

Preferred cyclic amine based polymer, oligomer or copolymer materials which are suitable for use in laundry operations and provide the desired fabric appearance and integrity benefits are described in further detail in the copending provisional patent application of Panandiker et al., entitled "Laundry Detergent Compositions With A Combination Of Cyclic Amine Based Polymers And Hydrophobically Modified Carboxy Methyl Cellulose," having serial No. 60/148,053, P&G Case No. 7292P2, filed on Aug. 10, 1999, which is hereby incorporated by reference.

Leather Conditioner

In certain embodiments, the cleaning composition, such as the combination washing/conditioning composition may further comprise an optional leather conditioner if it is desired to wash garments or articles, such as coats, jackets, etc. that are comprised partially or entirely of leather and/or suede. In such a case, the cleaning composition may comprise a conditioning system. The conditioning system may comprises one or more conditioning agents.

The conditioning system preferably has a pH, as determined in a 10% aqueous solution of the neat conditioning system, in the range of from about 2.5 to about 10, more preferably from about 3 to about 8, most preferably from about 5 to about 7.

The viscosity of the conditioning system is preferably from about 0.5 to about 10,000, more preferably from about 0.5 to about 1000, most preferably from about 1 to about 100 cps.

Conditioning Agents—In order to achieve conditioning of garments or articles containing leather or suede, it may be desirable to use one or more conditioning agents during the cleaning process.

The conditioning agent(s) can be used independently of the other components, described herein, that may be within the cleaning composition (i.e., surfactants, etc.), or the conditioning agents can be combined with one or more other components of the cleaning compositions.

The conditioning agents useful in the cleaning compositions can be any conditioning agent that mitigates damage to garments or articles containing leather or suede as a result of washing the garments or articles in an aqueous medium and/or maintain, restores, or improves the softness, suppleness and/or flexibility of the leather or suede after washing the garments or articles in an aqueous medium.

Suitable conditioning agents useful in the methods and compositions of the present invention include, but are not limited to, acrylic syntans and other hydrophobically modified polymers, silicones, fluorocarbons, fatliquors, lecithin, fluoropolymers, sucrose polyesters, oils, waxes, quaternary ammonium salts and mixtures thereof. Preferably, the conditioning agents are selected from the group consisting of acrylic syntans and other hydrophobically modified polymers, silicones, fatliquors, lecithin, fluoropolymers, sucrose polyesters, oils, waxes, quaternary ammonium salts and mixtures thereof. More preferably, the conditioning agents are selected from the group consisting of acrylic syntans and other hydrophobically modified polymers, silicones and mixtures thereof. Most preferably, the conditioning agents are acrylic syntans.

Suitable hydrophobically modified polymers include, but are not limited to, partially esterified polyacrylate (acrylic syntan), glycoproteins and cellulose derivatives.

Preferred acryclic syntans have the following formula:

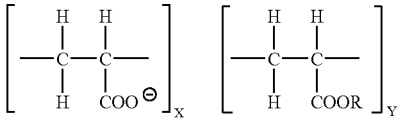

wherein R is independently $C_8$–$C_{20}$ alkyl, and X and Y are independent integers. Preferably, the X/Y ratio is from about 0.05 to about 100, more preferably from about 0.5 to about 50, most preferably from about 1 to about 20.

In addition to the above defined ratios for acrylic syntan compounds, proton NMR methodology can be used to evaluate other potential hydrophobically modified polymers. Wherein the ratio of "hydrophilic" protons (H's attached to C adjacent to O (approximately δ 3.0–4.1 ppm)) to "hydrophobic" protons (H's attached to C non-adjacent to O (approximately δ 0.5–2.0 ppm)) is from about 0.05 to about 100, more preferably from about 0.5 to about 50, most preferably from about 1 to about 20.

One of the main advantages of the acrylic syntans is that, they both soften and retan the leather. While not to be bound by the theory, it is believed that the syntan polymer deposits and lubricates the leather fiber. This reduces the friction between the leather fiber and fibrils thus makes the leather soft and supple. Besides softening, the polymer also stabilize the leather by fixing other tanning agents such as chromium.

Another advantage of the acrylic syntan compounds is to maintain and/or minimally disturb the water absorption properties of the leather and suede portions of the garments or articles. This tends to reduce the moisture level inside the garment or article.

Typical acrylic syntan compounds have both hydrophobic and hydrophilic characteristics. Commercially available acrylic syntans are available from Rohm & Haas Company of Philadelphia, Pa., under the tradenames LEUKOTAN® and LUBRITAN®, preferred acrylic syntans available from Rohm & Haas Company are LEUKOTAN® NS3 and LUBRITAN® AS, a highly preferred acrylic syntan available from Rohm & Haas Company is LUBRITAN® AS.

Oftentimes, the conditioning agents include organic solvents, such as butoxy propanol. The conditioning agents which can be used herein can contain organic solvents or be organic solvent-free.

Emulsifying agents can be added to stabilize the syntan dispersion solutions. Common anionic, cationic, nonionic, ampholytic and zwitterionic surfactants can all be used for this purpose.

Silicone compounds are well known for their lubrication capabilities. Either unmodified PDMS (PolyDiMethyl Siloxane) or organo-PDMS can be used for the present invention. Nonlimiting examples include GE CM2233, SM2658, or Dow Corning 51. Additionally, polyalkyleneoxide modified polydimethylsiloxane available under the tradename SILWET-7500 from Osi Specialties can also be used in the compositions of the present invention.

Fatliquors are historically used in the tanning industry to soften the leather. They generally are vegetable, animal and marine fats or a blend of these. Often it is partially sulfated or sulfonated so that it can be dispersed evenly in an aqueous medium and penetrate leather effectively. Sometimes surfactants are added to emulsify the oil. Nonlimiting examples of the fatliquors are Chemol 45 and Chemol 130 by Chemtan Co.

Suitable fluorocarbon polymers include, but are not limited to, F84, F89 and F3700 fluoropolymers from Mitsubishi International Corp.

Suitable quaternary ammonium compounds useful as conditioning agents include, but are not limited to, ditallow dimethyl ammonium chloride.

Commercial lecithins, or phospholipid compounds are used to soften and cure leathers. It also can be used as an emulsifying agent during the fatliquoring step to aid the penetration of fatliquor compounds. Nonlimiting examples of such materials are Centrolene A and Centrophase HR2B commercially available from Central Soya Company.

Suitable sucrose esters of fatty acids can be used as fat substitutes to lubricate the surfaces of garments or articles containing leather.

Preferred Form of Conditioning System

The conditioning system can be in the form of aerosol gas, liquid, powder, gel and/or tablet. Preferably, the conditioning system is a liquid. The conditioning system can be applied to one or more garments or articles either in association with the cleaning composition or separately by itself.

Preferred Means of Delivering Conditioning System

Conditioning agents can be applied either as part of the cleaning composition (2 in 1) or added separately. Further, one or more conditioning agents may be applied to one or more surfaces of a garment or article via a wash solution ("Through the Wash") containing the conditioning agents. Further yet, one or more conditioning agents may be applied to one or more surfaces of a garment or article after washing the garment or article (post-treat).

Polymeric Soil Release Agent—Soil release agents may also be used. If so, they will generally comprise from about 0.01% to about 10.0%, by weight, of the detergent compositions herein, typically from about 0.1% to about 5%, preferably from about 0.2% to about 3.0%.

Any polymeric soil release agent known to those skilled in the art can optionally be employed in the compositions and processes of this invention. Polymeric soil release agents are characterized by having both hydrophilic segments, to hydrophilize the surface of hydrophobic fibers, such as polyester and its blends, and hydrophobic segments, to deposit upon hydrophobic fibers and remain adhered thereto through completion of washing and rinsing cycles and thus, serve as an anchor for the hydrophilic segments. This can enable stains occurring subsequent to treatment with the soil release agent to be more easily cleaned in later washing procedures.

The polymeric soil release agents useful herein especially include those soil release agents having: (a) one or more nonionic hydrophile components consisting essentially of (i) polyoxyethylene segments with a degree of polymerization of at least 2, or (ii) oxypropylene or polyoxypropylene segments with a degree of polymerization of from 2 to 10, wherein said hydrophile segment does not encompass any oxypropylene unit unless it is bonded to adjacent moieties at each end by ether linkages, or (iii) a mixture of oxyalkylene units comprising oxyethylene and from 1 to about 30 oxypropylene units wherein said mixture contains a sufficient amount of oxyethylene units such that the hydrophile component has hydrophilicity great enough to increase the hydrophilicity of conventional polyester synthetic fiber surfaces upon deposit of the soil release agent on such surface, said hydrophile segments preferably comprising at least about 25% oxyethylene units and more preferably, especially for such components having about 20 to 30 oxypropylene units, at least about 50% oxyethylene units; or (b) one or more hydrophobe components comprising (i) $C_3$ oxyalkylene terephthalate segments, wherein, if said hydrophobe components also comprise oxyethylene terephthalate, the ratio of oxyethylene terephthalate:$C_3$ oxyalkylene terephthalate units is about 2:1 or lower, (ii) $C_4$–$C_6$ alkylene or oxy $C_4$–$C_6$ alkylene segments, or mixtures therein, (iii) poly (vinyl ester) segments, preferably polyvinyl acetate), having a degree of polymerization of at least 2, or (iv) $C_1$–$C_4$ alkyl ether or $C_4$ hydroxyalkyl ether substituents, or mixtures therein, wherein said substituents are present in the form of $C_1$–$C_4$ alkyl ether or $C_4$ hydroxyalkyl ether cellulose derivatives, or mixtures therein, and such cellulose derivatives are amphiphilic, whereby they have a sufficient level of $C_1$–$C_4$ alkyl ether and/or $C_4$ hydroxyalkyl ether units to deposit upon conventional polyester synthetic fiber surfaces and retain a sufficient level of hydroxyls, once adhered to such conventional synthetic fiber surface, to increase fiber surface hydrophilicity, or a combination of (a) and (b).

Other suitable polymeric soil release agents are disclosed in U.S. Pat. No. 5,415,807, issued May 16, 1995 to Gosselink, which is hereby incorporated by reference.

Combinations of Fabric Care Components—While they may be effectively used separately, it is preferred that cyclic amine based polymer/oligomer/copolymer materials and dye transfer inhibiting agents such as polyvinyl pyrrolidone polymers, polyamine N-oxide polymers, copolymers of N-vinylpyrrolidone and N-vinylimidazole, manganese phthalocyanine and peroxidases (described above in the section on wash pretreatment compositions) be used in combination to provide optimum suppression of dye-transfer between garments, particularly in mixed colored loads (i.e. mixed light and dark-colored fabrics).

Other Cleaning Compositions

Non-limiting examples of cleaning compositions in the form of a foam or mousse are described in European Patent Application 0 677 577 A1 entitled "Foamed Cleaning Compositions and Method of Treating Textile Fabrics", published Oct. 18, 1995 in the name of J. Wevers (P&G Case CM683FM); U.S. Pat. Nos. 5,925,608 and 6,021,926 entitled "Packaged Foaming Composition", issued to Michael Spruyt, et al. on Jul. 20, 1999 and Feb. 8, 2000, respectively (P&G Case CM981F); European Patent Application 0 753 557 A1 entitled "Packaged Foaming Composition", published in the name of J. Wevers (P&G Case CM 982F); European Patent Application 0 753 558 A1 entitled "Packaged Foaming Composition", published Jan. 15, 1997 in the name of P. Etesse (P&G Case CM983F); European Patent Application 0 753 559 A1 entitled "Method of Cleaning Textile Fabrics", published Jan. 15, 1997 in the name of J. H. Verbiest, et al. (P&G Case CM984F); and U.S. Pat. No. 5,853,618 entitled "Foam", issued Dec. 29, 1998 to C. L. Barker, et al. (P&G Case CM985F).

Introduction of the Combination Washing/Conditioning Composition Into the Cleaning Process The combination washing/conditioning composition can be introduced into the washing process in any suitable manner. The following are some non-limiting manners in which the combination washing/conditioning composition can be introduced into the washing process. In one embodiment, the combination washing/conditioning composition can be poured into the washing machine in the same manner as conventional detergents.

In another embodiment, the composition can be applied directly to the garments to be cleaned. The cleaning composition can be applied to the garment in any suitable manner including, but not limited to the following: (a) applying a liquid cleaning composition onto the garment with a brush; (b) drizzling a liquid cleaning composition onto the garment; (c) spraying the cleaning composition onto the garment; (d) applying the cleaning composition onto the garment with a roller; (e) applying the cleaning composition onto the garment by padding; (f) dispensing a foam cleaning composition onto the garment; and, (g) dusting a powder cleaning composition onto the garment.

In another embodiment, the composition can be applied to an article which is placed inside of the flexible wrap container, and the flexible wrap container with the article inside can be placed in the washing machine together. There are a non-limiting number of variations of this latter embodiment. For example, in one variation, the composition can be applied to a dosing pad, and the dosing pad can be placed in the flexible wrap container with the garments to be cleaned.

The dosing pad can be of any suitable size and configuration. For example, the dosing pad can be of a size that ranges up to, or even larger than, the size of one of the panels of the flexible wrap container. In one non-limiting embodiment, the dosing pad is a rectangular pad or sheet having a dosing area demarcated thereon measuring 4 cm×40 cm. The dosing pad can be made of any suitable material (preferably, without any dyes) that is capable of retaining the detergent composition when it is applied, and then releasing the detergent composition during the wash cycle. For example, the dosing pad may be a nonwoven web or a foam sheet. The dosing pad can be placed into the wrap in any suitable manner in any suitable location. In one non-limiting embodiment, the dosing pad is positioned in the top triangle of the garment wrap, and sewn on the wrap. The detergent mousse is preferably applied to the dosing area of the dosing pad by applying the mousse using a single motion to the dosing area using a foam dispenser, preferably a pressurized container, one non-limiting example of which is an aerosol can.

In other variations of this latter embodiment, the cleaning composition can be applied to an article which is placed inside of the flexible wrap container, or the cleaning composition can be inserted into the flexible wrap container in other manners. Such other manners include, but are not limited to: applying the cleaning composition into the washing machine using a material with a dry or wet cleaning composition thereon (e.g., on a dry or wet sheet); and, rolling or folding the flexible wrap container and then injecting, or otherwise inserting, the cleaning composition into the folded wrap.

The Flexible Wrap Container

The action of the agitator in a clothes washer has long been known to expose delicate fabrics to sufficient abrasion and stress that severe damage can occur as a result. As a result, bags have been developed which can be used in a washing machine to protect these garments from abrasion and stress. Nonetheless these have proved unsatisfactory for a variety of reasons. First, they are generally too small to contain anything but one or two small garments-and even then may bunch-up the garments and exacerbate wrinkling and shape loss. Second, many of these bags do not have a reliable closure means, and so the bag often comes open during washing, depriving the garments of the protection the bag is supposed to provide and likely increasing the abrasion and wear on the garments. Third, these bags are often constructed to have an outer shell made of a grid-like netting which allows contact between the wash liquor and the garment to provide cleaning benefits; but this grid-like pattern can also leave an identical grid impression on the garments contained inside. Such a pattern may be difficult to iron out.

Figure 1A:
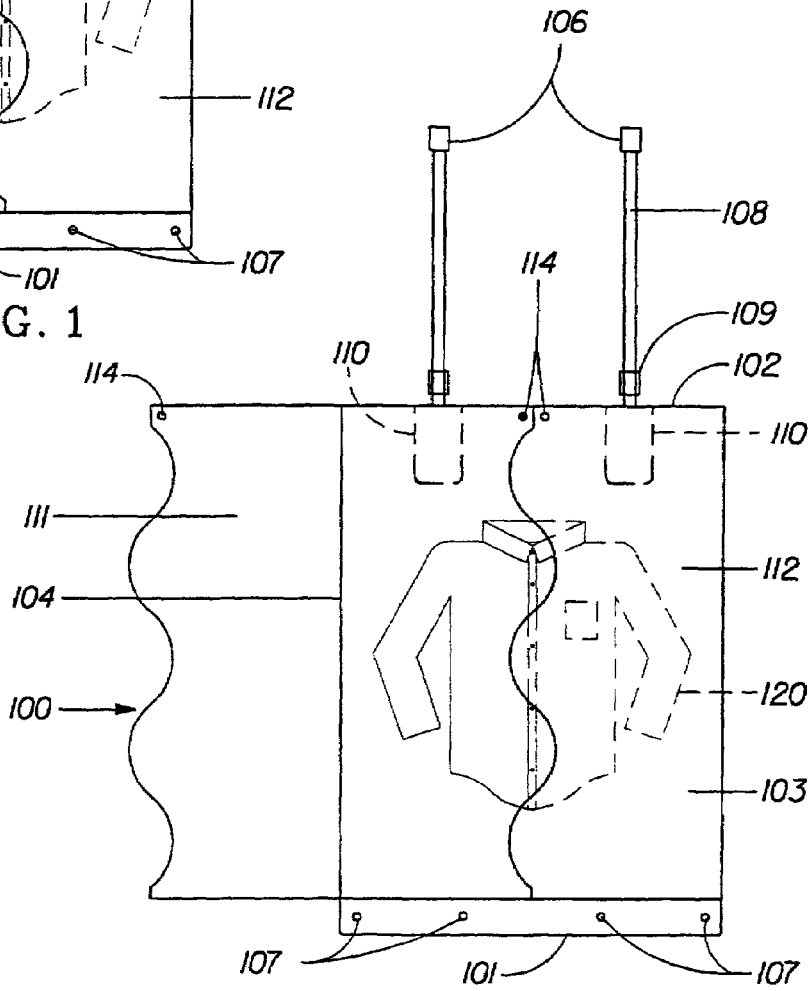
FIG. 1A is a side view illustrating the flexible wrap container 122 and showing two attached flaps, a first flap 111 being folded out and a second flap 112 being folded over the panel.
Figure 2:
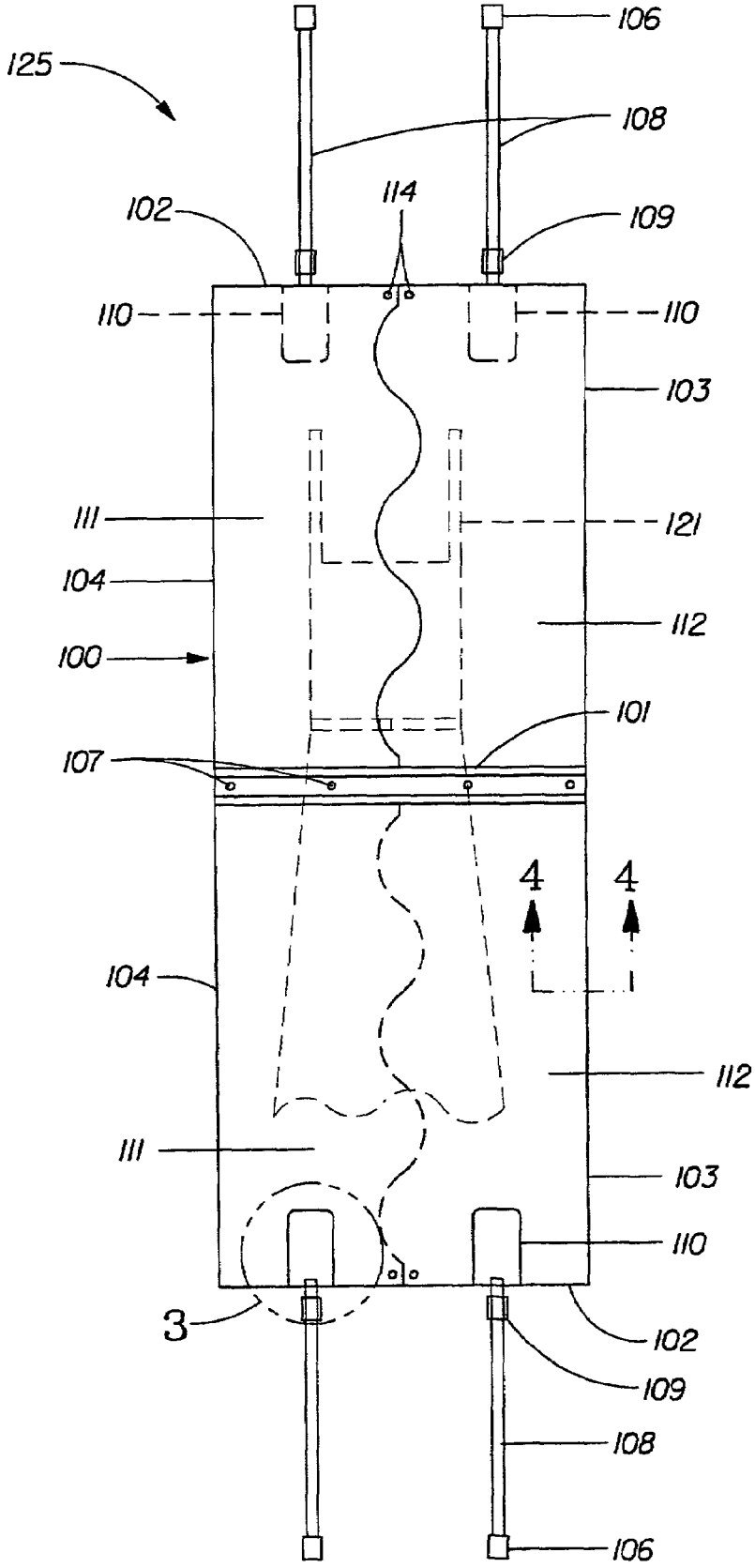
FIG. 2 is a side view illustrating an enlarged flexible wrap container 125. In this embodiment, the two wraps can be attached to each other via connecting means 107 located adjacent to the bottom edge of the panel 101 of each flexible wrap container 122 to form an enlarged flexible wrap container 125.
Figure 3:
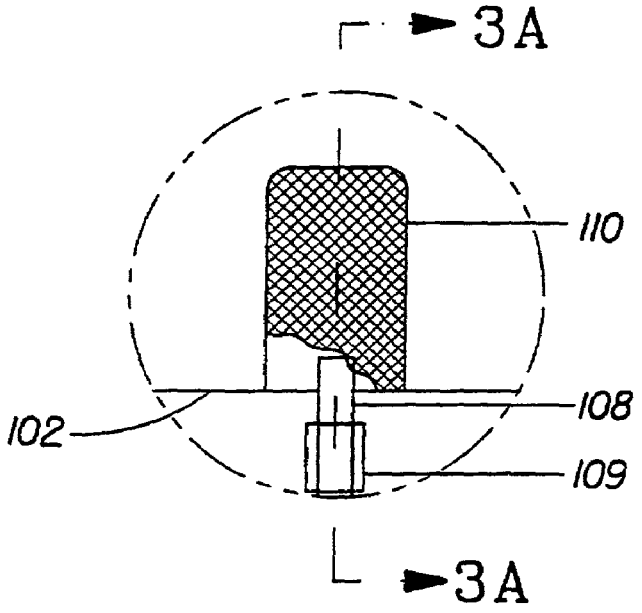
FIG. 3 is a detail illustrating a pocket 110 attached to the panel of the flexible wrap container which provides a storage area for the extra straps and fastening devices when two flexible wrap containers are attached to form an enlarged flexible wrap container as in FIG. 2.
Figure 3A:
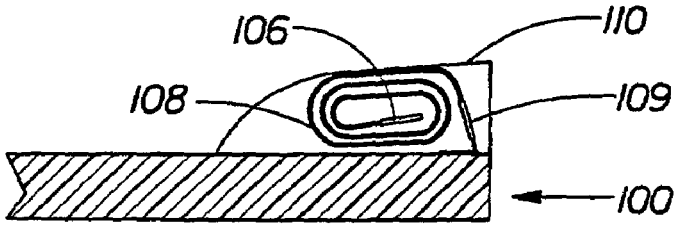
FIG. 3A is a sectional side view of the pocket 110 illustrating the storing of straps and fastening devices in the attached pockets when two flexible wrap containers are attached to form an enlarged flexible wrap container as in FIG. 2

One embodiment of flexible wrap container ("wrap") made in accordance with the present invention which remedies many of these problems is shown in FIGS. 1, 1A and 2. The wrap 122 can be of any suitable size and shape. In the embodiment shown in FIGS. 1, 1A, and 2, the wrap 122 comprises a single, preferably rectangular, panel 100. The dimensions of the panel 100 are such that the width will be about 30.5 cm to about 91.4 cm and the length will be about 55 cm to about 117 cm; more preferred is a width of about 40.6 cm to about 81 cm and a length of about 66 cm to about 107 cm and most preferred is a width of about 51 cm to about 71 cm and a length of about 76 cm to about 97 cm. In a rectangular embodiment as depicted in FIG. 1, the distance from the top edge of the panel 102 to the bottom edge of the panel 101 is preferably greater than the distance from the right edge of the panel 103 to the left edge of the panel 104.

The wrap 122 preferably further comprises one or more straps 108 which are attached adjacent to the top edge of the panel 102. At an end of each strap is a first fastening device 109 which is fixably and permanently attached to each strap 108 so that its position on the strap does not change. A second fastening device 106 is preferably attached to each strap by passing the strap through the fastening device in such a way that changing its position on the strap, the length of the strap 105 can be increased or decreased. The first and second fastening devices cooperate to secure the flexible wrap container in a roll-like shape during use (see, e.g., FIG. 7), or a folded shape (see, e.g., FIGS. 16–19). Additionally, two pockets 110 are preferably attached adjacent to the top edge of the panel in the manner shown by FIGS. 1, 1A, 2 and 3. As discussed more fully hereafter, the pockets 110 can be used for storing the straps and fastening devices when they are not needed.

The fastening devices used herein are preferably reusable mechanical fasteners. Any reusable mechanical fastener or fastening means can be used. Non-limiting examples include: fasteners wherein said first and second fastening devices, together, comprise a hook and loop (VELCRO®-type) fastener; hook fasteners such as described in U.S. Pat. No. 5,058,247 to Thomas & Blaney issued Oct. 22, 1991; fasteners wherein said first and second fastening devices, together, comprise a hook and string type fastener; fasteners wherein said first and second fastening devices, together, comprise a toggle-type fastener; fasteners wherein said first and second fastening devices, together, form a snap-type fastener; as well as hook and eye fasteners, zipper-type fasteners, releasable buckle type fasteners as used in U.S. Pat. No. 5,330,141, to Kim, issued Jul. 19, 1994, and the like, so long as the fasteners will not cause tearing or abrasion of the garments contained inside the bag. As will be apparent, a single fastening device can also be utilized with one or more straps to secure the wrap container in its rolled or folded configuration.

The flexible wrap container may be constructed from any suitable material, including, but not limited to: woven materials, nets, scrims, and nonwoven materials. The structural elements or members (e.g., the strands, fibers, threads, yarns, etc.) of the wrap can also comprise any suitable material or materials. Suitable materials for these structural components of the wrap include, but are not limited to: nylon, polyethylene, polypropylene, polyester, and combinations thereof. The structural components of the wrap 122 may also be coated with any suitable material, such as an acrylic material. The material(s) comprising the wrap can be in one or more layers. If more than one layer of material is used, the (structural components of the) layers can be comprised of the same material, or a different material. The layers may comprise the same type of structure, or a different type of structure. If more than one layer of material is used, the layers can be joined together directly or indirectly by any known method of joining known. The flexible wrap is preferably constructed to have a density greater than the density of water at standard temperature and pressure so that the flexible wrap container is more likely to sink in the wash water and thus will provide better wetting and rinsing to a garment contained therein. The material should be flexible, yet durable enough to be used for multiple uses. To ensure that water can easily penetrate through the wrap material to contact the articles of clothing contained inside, the wrap 122 is preferably provided with a series or plurality of holes or other openings, or the wrap material should be permeable to water.

If the wrap 122 is provided with holes or openings, the size and number of openings are preferably sufficiently large to allow water and any cleaning solution that is outside of the wrap 122 to wet the garments to be cleaned, as well as to allow dirt particles to be carried away from the garments. The holes or openings, are preferably not so large that portions of the garments to be cleaned are overly exposed to damage in the washing machine, or are marked with the pattern of the wrap.

The wrap 122 is preferably flexible enough that the garments contained therein are subjected to a degree of mechanical agitation to assist in cleaning the garments, but sufficiently stiff that the wrap contains the garment and the garments will not be subjected to undue wrinkling, abrasion, and shrinkage.

The flexibility (or stiffness) of the wrap materials described herein are measured using the Taber Stiffness measurement (ASTM D5342). The stiffness of the wrap material can be measured in one direction relative to the weave or knit of the wrap material, or it can be measured in two directions (such as, in the case of a square weave, in a first direction parallel to the warp yarns or, and in a second direction at a right angle thereto (e.g., parallel to the weft yarns). If the stiffness of the wrap material is measured in two directions, the Taber stiffness measured in two directions can be averaged. The wrap material preferably has a stiffness in one direction, as well as an average stiffness in two directions, of between about 3 and about 90 Taber stiffness units, more preferably between about 10 and about 50 Taber stiffness units. The lower end of the above range can also be higher than 3 Taber stiffness units. For example, the lower end can be any number within the range (e.g., 4, 5, 6, . . . , etc., 15, 20, 25, 30, 35, 40, 45, 50, 55, 60, 65, 70, or 75) even though the number is not specifically stated herein.

A few non-limiting examples of suitable materials for the wrap are a woven, three-dimensional material known as double needle bar (DNB), and a woven acrylic coated polyester (ACP) mesh material. In one embodiment, the DNB is a material manufactered by Autotech in Spain and obtained from Milliken & Company, Spartanburg, S.C., USA. This double needle bar material has an average Taber stiffness (using four samples) in a first direction of 12, and an average Taber stiffness (using four samples) in a second direction at right angles thereto, of 13.

The woven acrylic coated polyester (ACP) material is preferred because it is somewhat stiffer than the DNB material, and without wishing to be bound to any particular theory, as a result is believed to be better able to contain and keep the garments in tension in the condition/position in which they are originally placed in the wrap and reduce movement of garments inside the wrap during the washing process, while allowing water and cleaning solution easily enter through its porous structure. This has led to improvements in reducing wrinkling, abrasion, and shrinkage of the garments after washing. The woven acrylic coated polyester material has the desired stiffness in a structure that has very little thickness or three-dimensionality to it. This is in contrast to the Double Needle Bar material, which is comprised of three different thread types to give it the appearance of three layers, in which each "layer" is very flexible, but when combined together into a relatively thick three-dimensional structure, has a stiffness greater than any of the "layers" alone. The woven acrylic coated polyester material is a single layer material with one thread type, and can, thus, be considered to be a two-dimensional material.

The stiffness of materials used in the wrap can be varied in manners known to those skilled in the art of making such materials. For example, the addition of the acrylic coating provides additional stiffness. In addition, modified weaving/knitting patterns and/or type of yarn or thread used to weave or knit a fabric can increase or decrease the stiffness of the wrap.

Preferred woven acrylic coated polyester materials are material numbers 961376 and 961377 obtained from Milliken & Company of Spartanburg, S.C. The threads of these materials preferably have a diameter of between about 0.1 mm and about 0.3 mm, and more preferably have an oval cross-section with a minor diameter of about 0.14 mm and a major diameter of about 0.23 mm. One of these materials (961377) has square shaped openings in the weave that are approximately 1 mm×1 mm in size. The total open area of this material is approximately 0.6 $mm^2/mm^2$ (open area in $mm^2$ per square mm of material). This material is stretchable in one direction, but not in a direction at a right angle thereto. The other material (961376) has rectangular openings that are approximately 1.5 mm×2 mm. This material is approximately 0.5 mm thick. The total open area of this material is approximately 0.7 $mm^2/mm^2$.

The wrap can optionally be comprised of materials that reduce any potential for the wrap to absorb fugitive dyes from the garments being washed therein. The wrap can, for example, have a soil release polymer, or other material having this property included therein, or provided thereon in any suitable manner. For instance, a soil release polymer of the type described herein may be coated on the structural elements comprising the wrap (e.g., the yarns). In another non-limiting example, a soil release polymer can be incorporated into the material comprising the structural elements of the wrap prior to or during the formation of those structural elements. In still another example, a soil release polymer can be incorporated into any coating that is provided on the structural elements of the wrap (e.g., the soil release elements can be incorporated into the acrylic coating). Providing the wrap with such materials will reduce the potential for the wrap to absorb fugitive dyes and change color, and help assure the user of the wrap that the wrap is not removing dyes from the garments being washed, or transferring such dyes to other garments.

Figure 7:
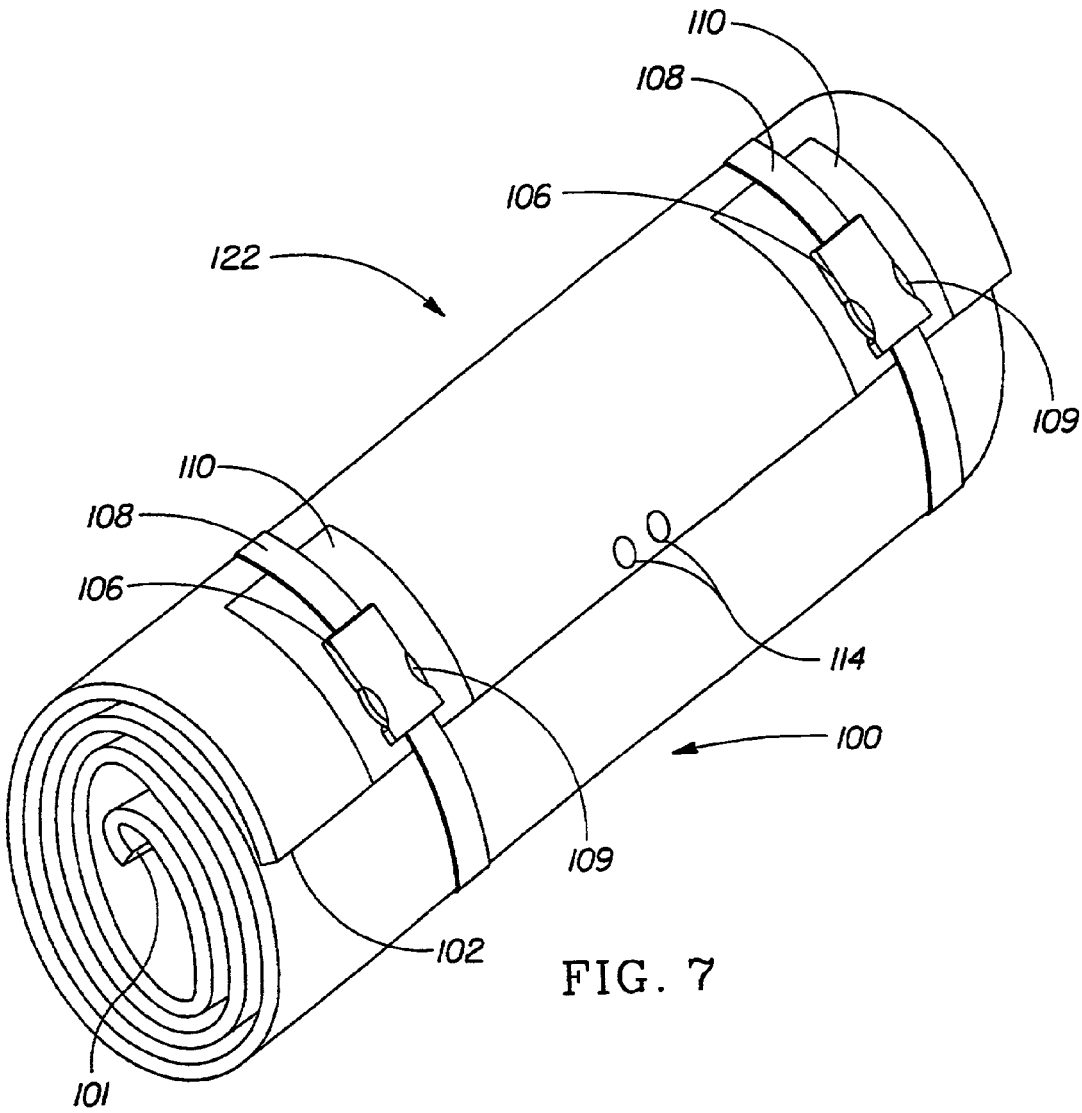
FIG. 7 is a perspective of the flexible wrap container 122 in a roll-like shape.

The manner in which the wrap is used in the present invention is straightforward. A garment 120 is placed on the panel portion of the wrap 100 with suitable care exercised so that no part of a garment is outside the dimensions of the panel. After placing the garment on the panel, the wrap may in one embodiment then be rolled, starting at the bottom edge of the panel 101, as one would roll a sleeping bag for storage purposes after being used. The wrap should not be so tightly rolled that the garment inside might be subject to excessive wrinkling. When rolling is completed the wrap 122 should be in the spiral shape as illustrated by FIG. 7. As seen in FIG. 7, the length of each strap has been adjusted so that when the first and second fastening devices are engaged, the straps are tightly securing the rolled wrap.

Alternatively, the wrap may be folded rather than rolled. FIGS. 16 to 19 show a non-limiting embodiment of a folded wrap where the wrap is folded twice to form a four layer structure. The wrap may be folded in any other suitable manner. For example, the wrap can be folded in half, or the wrap may be folded into a three or more layer structure. Folding the wrap instead of rolling it may, in some washing machines (especially Japanese washing machines) tend to reduce the wrinkling of the garments after washing.

Located adjacent to the bottom edge of the panel are at least two, preferably at least four, connecting means 107 which in a preferred embodiment are snap-type buttons. The wraps are constructed in such a way that an enlarged wrap 125 may be constructed by attaching two wraps to each other via the connecting means 107 located adjacent to the bottom edge of each panel. This construction can be seen in FIG. 2. When the wraps are so connected, the panel of one wrap partially overlaps the panel of the other wrap as can be seen in FIG. 2. An enlarged wrap 125 can accommodate larger garments (such as a dress 121) than a single wrap 122.

When two wraps are attached to each other via the connecting means 107 located adjacent to the bottom edge of each panel as in the alternate embodiment depicted in FIG. 2, there are an extra set of straps 108 and first and second fastening devices 106, 109. The straps and the fastening devices are then placed for storage in the nearest attached pocket 110.

In a preferred embodiment, the wrap further consists of two flaps 111,112. The flaps are attached to the panel along the right edge of the panel 103 and along the left edge of the panel 104. Each flap has a surface area of from about ½ to 1 times the surface area of the panel to which it is attached. So when the flaps are folded inwardly and laid on top of the panel area, they completely cover the panel, essentially adding a second panel layer to the wrap. In the embodiment shown in FIGS. 1, 1A and 2, each flap has a mating sinusoidal design. The mating sinusoidal shape contributes to the overall integrity of the rolled wrap by fitting the two flaps 111, 112 more securely to each other than if the flaps had a conventional rectangular shape, and is believed to reduce the buckling of the wrap and wrinkling of the garments contained therein. FIG. 1A shows these two flaps: one being folded out 111 and one being folded over the panel 112. The flaps 111,112 and the panel 100 are also equipped with attaching devices 114 which are located adjacent to the top edge of the panel 102. When attached to each other these attaching devices secure the flaps to the panel 100.

Figure 4:
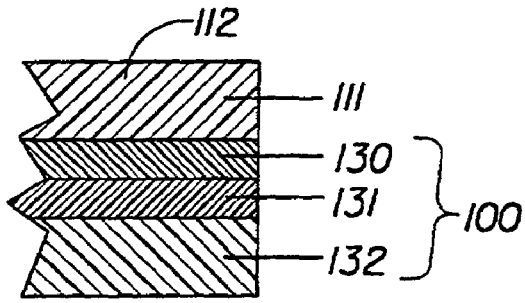
FIG. 4 is an enlarged sectional view showing a profile of the material layers in a preferred embodiment of the flexible wrap container 122.

In one embodiment of the present invention the wrap is constructed from four different layers as is shown in FIG. 4. These four layers provide a significant amount of cushioning to the delicate garments which may be placed inside. The panel 100 is a layered material, comprising a core material 131 between a first layer material 130 and a second layer material 132, the core material being polyester, the first layer material and the second layer material being nylon and the first flap and second flap each constructed from polyester. Optionally, the second layer material of nylon and the polyester material that forms the flaps are woven in such a way that they are provided with numerous small holes or pores through which water may pass either into or out of the interior of the rolled wrap while the second layer material does not have any such holes but is water permeable.

When the preferred flexible wrap container is used, it may contain two garments: one placed directly on top of the panel and the other placed on top of the flaps after they are folded across the garment on the panel.

Figure 8:
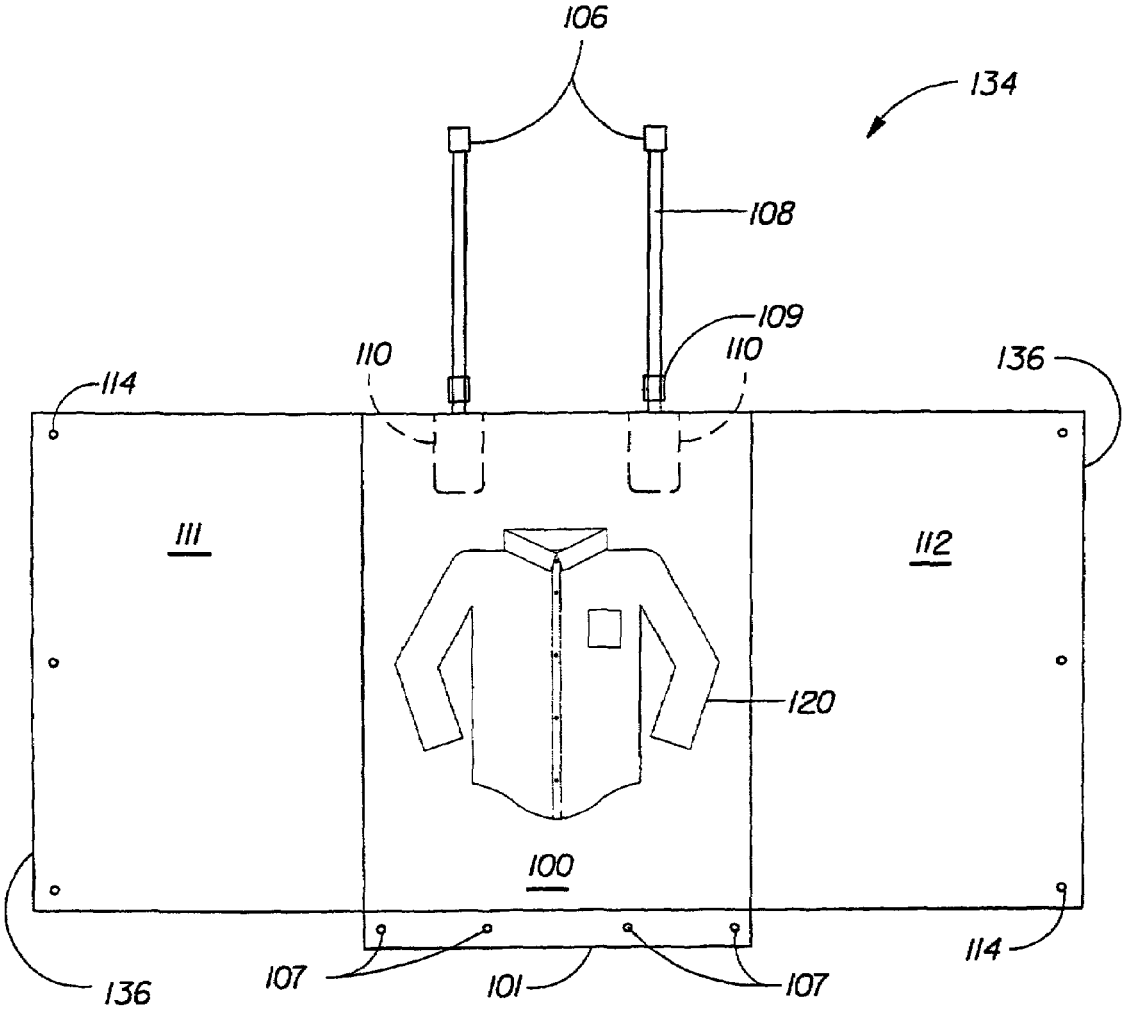
FIG. 8 is a top planar view of a preferred flexible wrap container made in accordance with the present invention, wherein overlapping first and second flaps which are illustrated in an open position.
Figure 9:
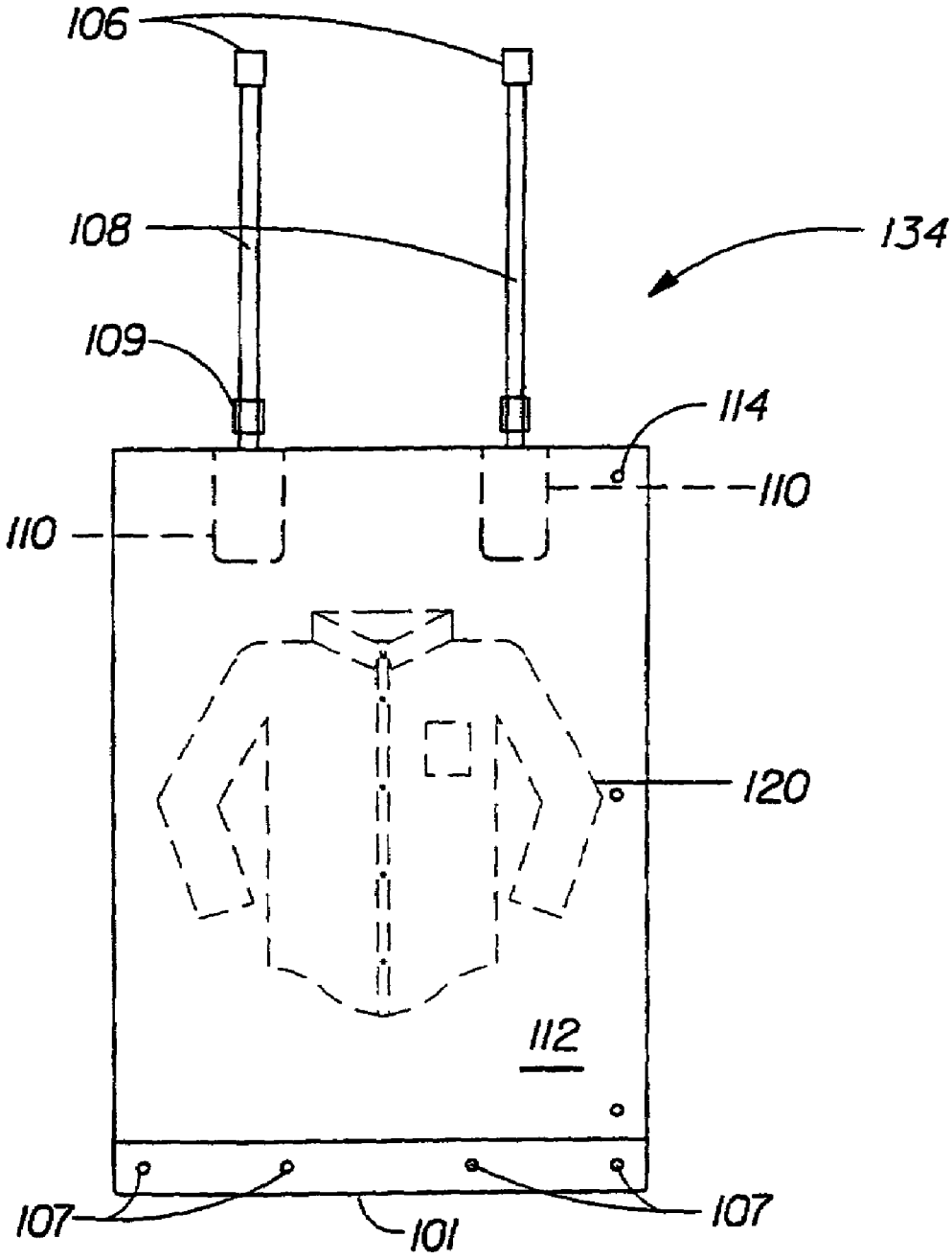
FIG. 9 is a top planar view of the flexible wrap container of FIG. 8, wherein the first and second flaps have been folded over the right and left edges of the panel of the flexible wrap container.

Referring to FIGS. 8 and 9, another preferred flexible wrap container made in accordance with the present invention is illustrated. The flexible wrap container 134 comprises the flexible panel 100 and a first flap 111 and a second flap 112. The first and second flaps 111 and 112 each preferably have a width about equal to the width of the flexible panel 100. More preferably, the first and second flaps 111 and 112 have a width between about 40 cm and about 70 cm for a flexible panel 100 having a width between about 45 cm and about 72 cm. In other words, the first flap 111 preferably extends adjacent to the right edge of the panel 100 when the first flap 111 is folded about the left edge of the panel 100 and the second flap 112 preferably overlaps the first flap 111 when folded about the right edge of the panel 100 and extends adjacent to the left edge of the panel 100. The flexible panel 100 and the first and second flaps 111 and 112 can be provided as separate structures and attached to the flexible panel 100 or the flexible panel 100 and the flaps 111 and 112 can be formed from a unitary material. While the distal or unattached edges 136 of the flaps 111 and 112 are illustrated as straight, other edge configurations, such as the previously described sinusoidal shape, can be provided. Further, any suitable number of attaching devices 114 (e.g., snaps, hook and loop fasteners, magnetic fasteners, etc.) can be provided along one or more of the distal edges 136 of the flaps 111 and 112 to secure the flaps to each other and/or the flexible panel 100.

Figure 10:
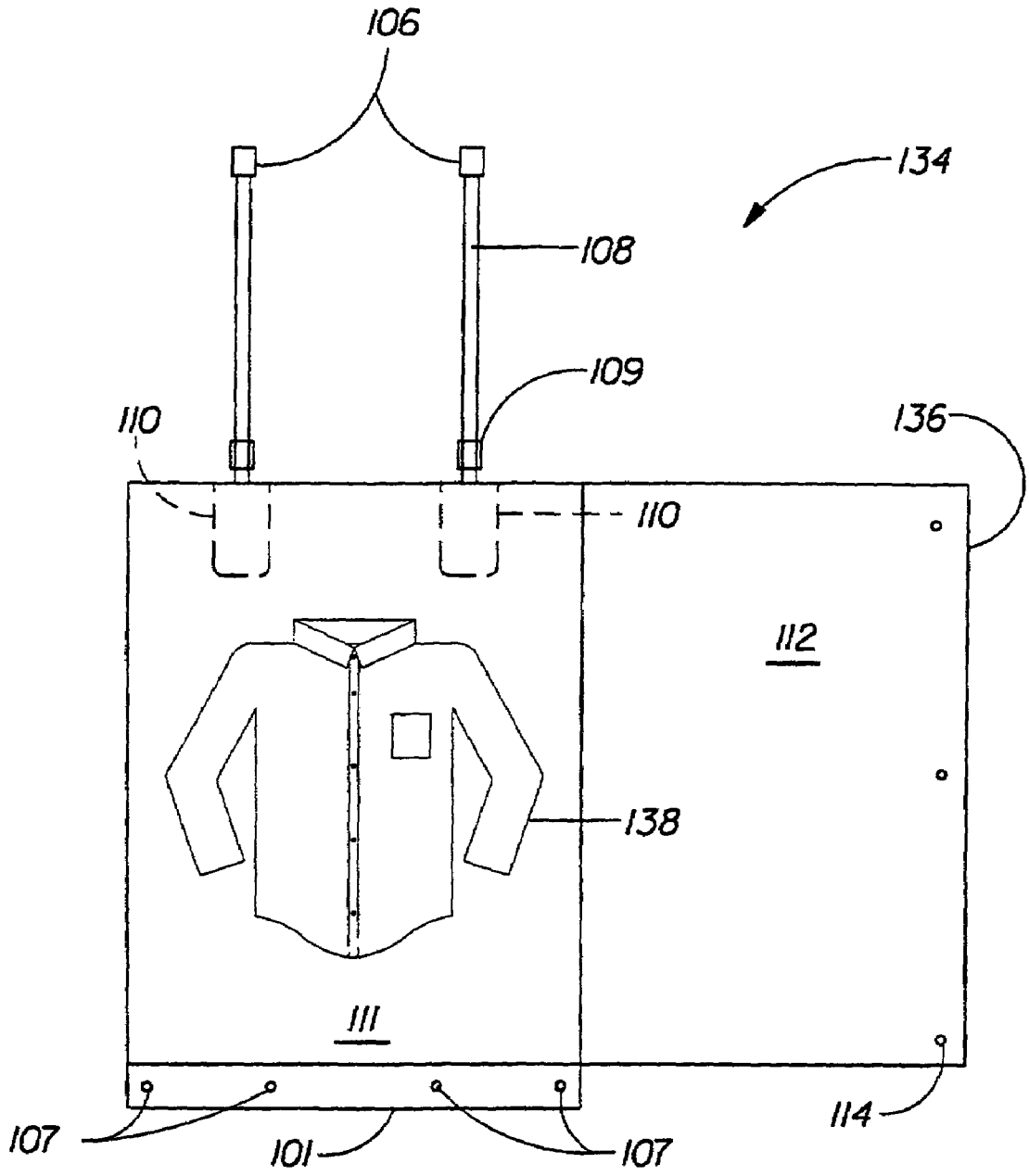
FIG. 10 is a top planar view of the flexible wrap container of FIG. 8, where the first flap has been folded over the left edge of the panel to illustrate placement of a second garment in the flexible wrap container.

Referring still to FIGS. 8 and 9, the overlapping flaps 111 and 112 deliver several benefits. For example, the increased width of the flaps 111 and 112 moves the distal edges 136 of the overlapping flaps 111 and 112 toward the right and left edges of the panel 100 and away from contact with the garment 120. This can reduce the likelihood that seams or stitching of the distal edges 136 will leave an impression upon the garment 120 during use of the flexible wrap container 134. The overlapping flaps 111 and 112 provide an additional layer of protection for the garment 120 and can reduce the risk that portions of the garment 120 will "escape" from the flexible wrap container 134. Overlapping flaps 111 and 112 also provide a flexible wrap container which can accommodate more than one garment. For example, the flaps 111 and 212 are extended to expose the flexible panel 100, as shown in FIG. 8. The garment 120 is placed over the flexible panel 100 and one of the flaps 111 or 112 is folded over the garment 120 as shown in FIG. 10 (flap 111 being illustrated as folded over the garment). Garment 138 is then placed over the folded flap (e.g., flap 111) and the remaining flap (e.g., flap 112) is folded over the garment 138 and secured using the attaching devices 114, if provided. The flexible wrap container 134 is then rolled and secured using the first and second fastening devices 106 and 109.

While the width of the overlapping flaps 111 and 112 is discussed herein as preferably extending to adjacent the right and left edges of the panel 100, the width of the overlapping flaps 111 and 112 is preferably between about one half and the full width of the panel 100. Alternatively, although less preferred, a single flap having a width equal to about the width of the panel 100 can be provided in place of the two overlapping flaps 111 and 112. Such an embodiment would preferably include attaching devices 114 to secure the single flap to the flexible panel.

Figure 11:
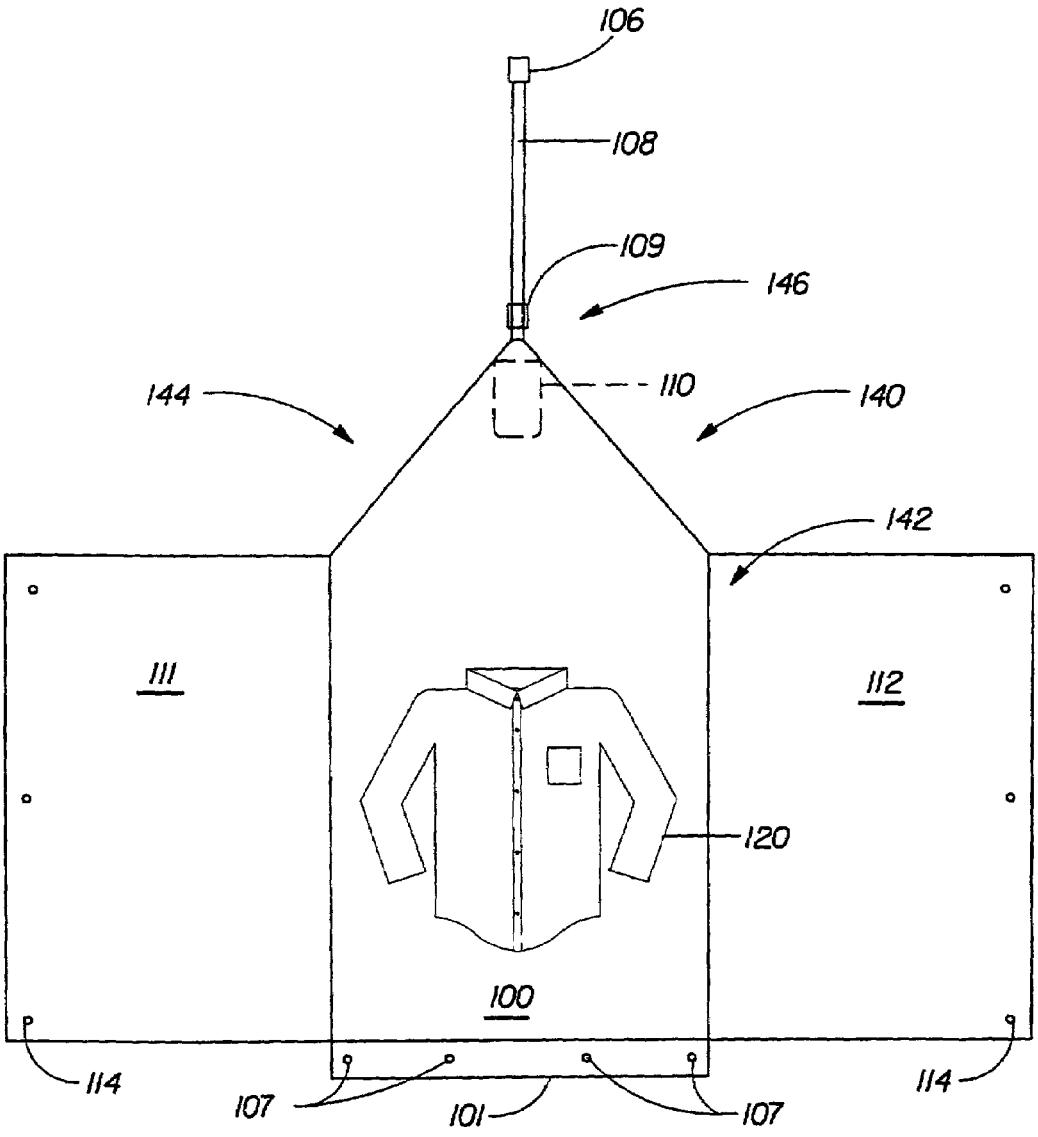
FIG. 11 is a top planar view of another flexible wrap container made in accordance with the present invention, wherein a tapered top portion is provided.

Yet another preferred flexible wrap container is illustrated in FIG. 11. The flexible wrap container 140 comprises a flexible panel 100 having a body 142 with a right edge, left edge, and a bottom edge. The flexible panel 100 also has a tapered top portion 144 which is attached to the body 142. The top portion 144 has an apex 146 which is located at about the mid-point of the body 142. The length of the tapered top portion 144 is preferably at least about one half of the length of the body 142. More preferably, the length of the top portion 144 is between about 40 cm and about 50 cm for a body having a length between about 75 cm and about 80 cm. A single strap 108 is attached adjacent the apex 146 of the top portion 144. At an end of the strap is a first fastening device 109 which is fixably and permanently attached to the strap 108 so that its position on the strap does not change. A second fastening device 106 is attached to the strap as previously discussed.

Figure 12:
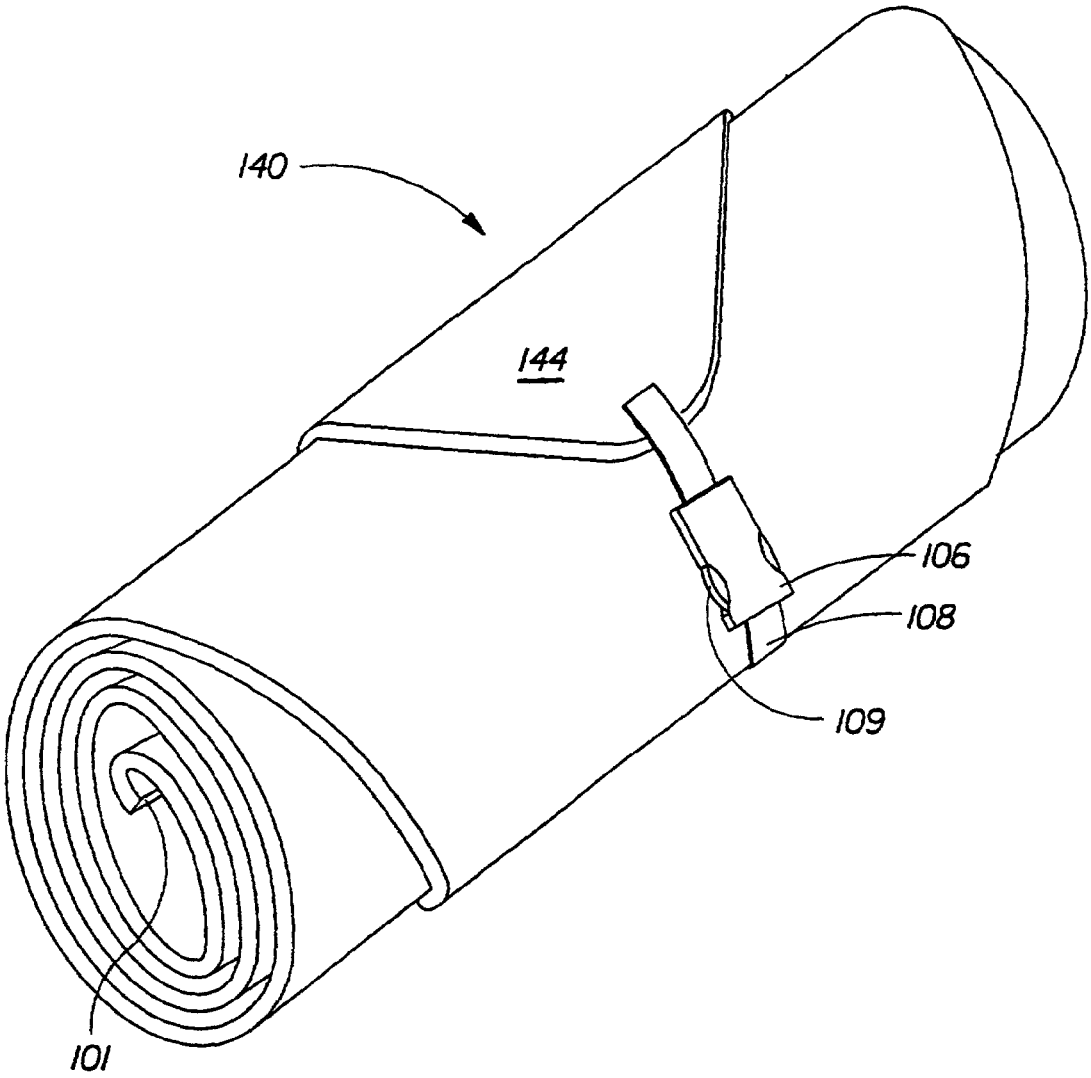
FIG. 12 is a perspective view of the flexible wrap container of FIG. 11, wherein the flexible wrap container is illustrated in a roll-like shape.

The inwardly tapering top portion 144 and/or provision of a single strap 106 adjacent its apex 146 can provide several surprising benefits during use of the flexible wrap container 140. The tapered top portion 144, when rolled about the body 142 during use, as shown in FIG. 12, imparts additional structure to the rolled flexible wrap container 140 by virtue of spiral layers 144 which encircle the body 142 when rolled. This additional structure assists in retaining the roll-like shape of the flexible wrap container 140 such that garments stored within the wrap require less finishing as the flexible wrap container 140 has a reduced tendency to twist or unroll from washing machine agitation. The flexible wrap container 140 with its a centrally located strap 108 in combination with the tapered top portion 144 also better resists the formation of gaps between layers of the rolled wrap container through which portions of a garment 120, such as sleeves or a neck, can be extracted during washing machine agitation. While the tapered top portion 140 or 144 illustrated herein is preferred, other top portions can be provided in accordance with the present invention. For example, the top portion 144 may displaced from the right and/or left edges of the body 142 or be provided with a larger apex or less of a taper.

Figure 13:
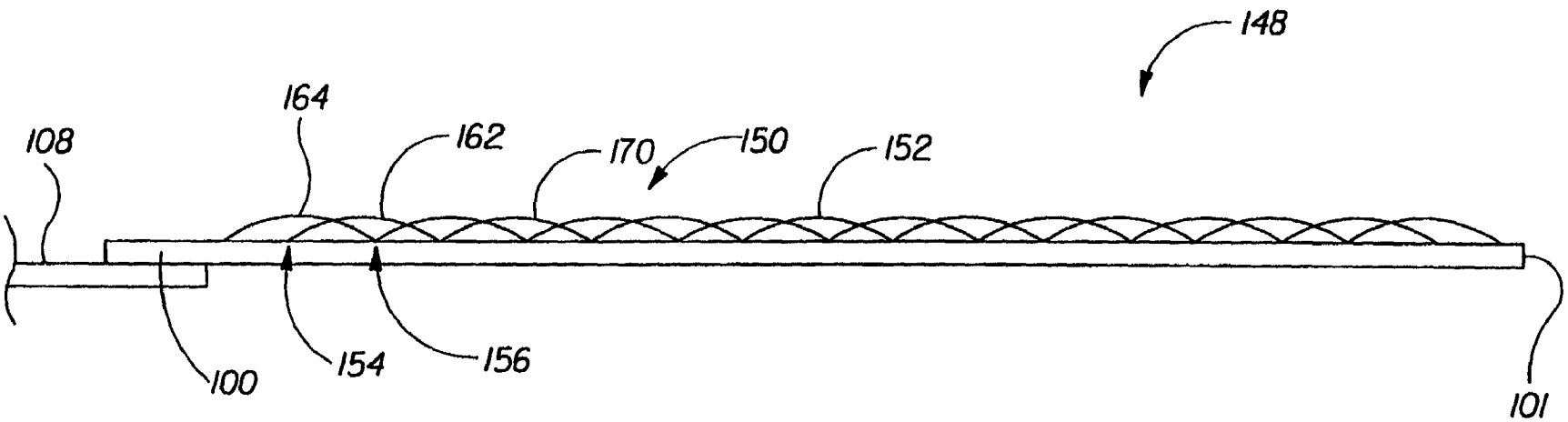
FIG. 13 is a side elevation view of yet another flexible wrap container made in accordance with the present invention, wherein a fence is provided along the edge of the flexible wrap container.
Figure 14:
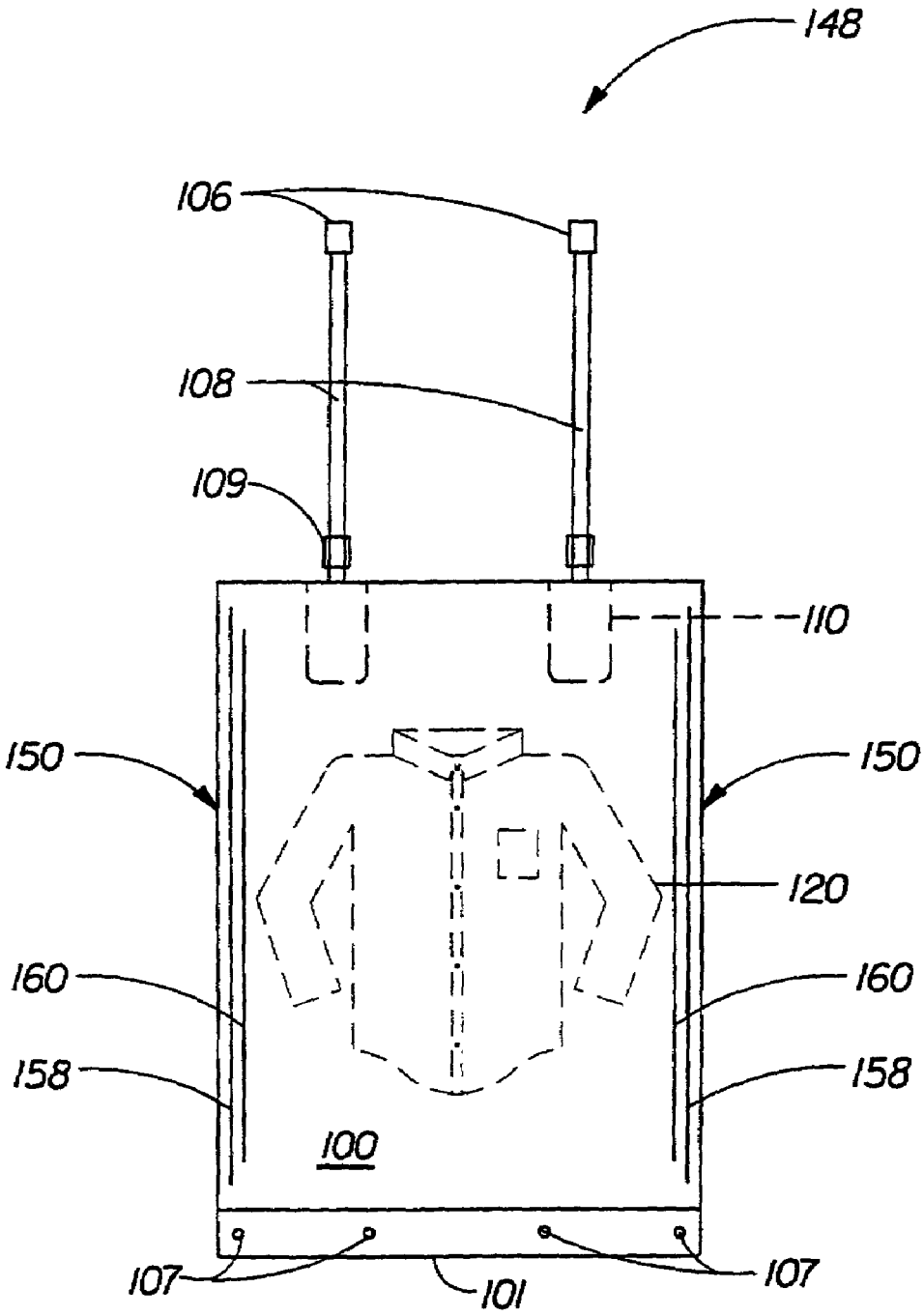
FIG. 14 is a top planar view of the flexible wrap container of FIG. 13.
Figure 15:
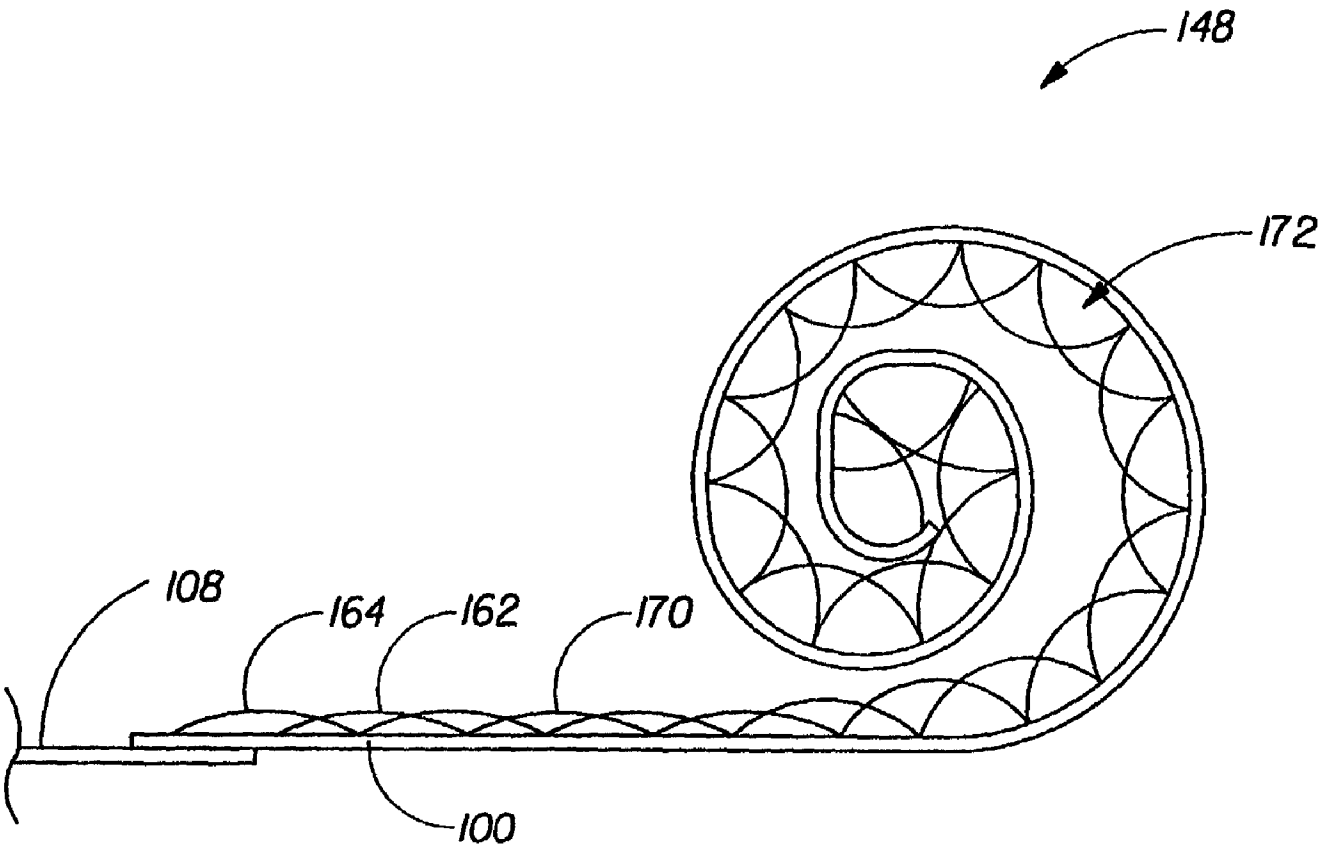
FIG. 15 is a side elevational view of the flexible wrap container of FIG. 13, wherein the flexible wrap container is illustrated in a roll-like shape.
Figure 16:
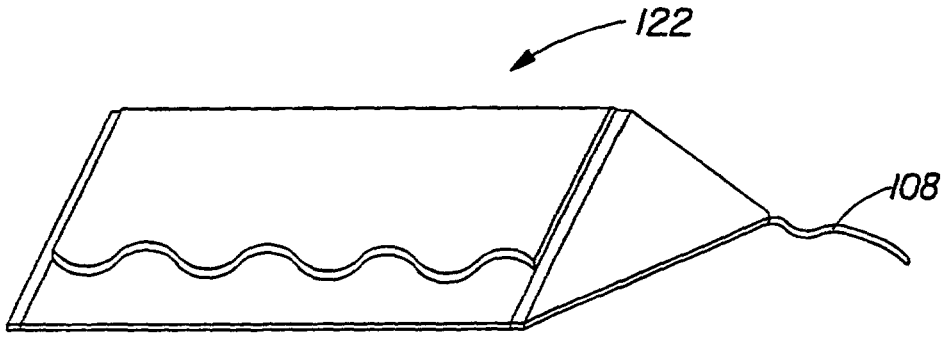
FIG. 16 is a perspective view of a wrap similar to that shown in FIG. 11 with the flaps folded over.
Figure 17:
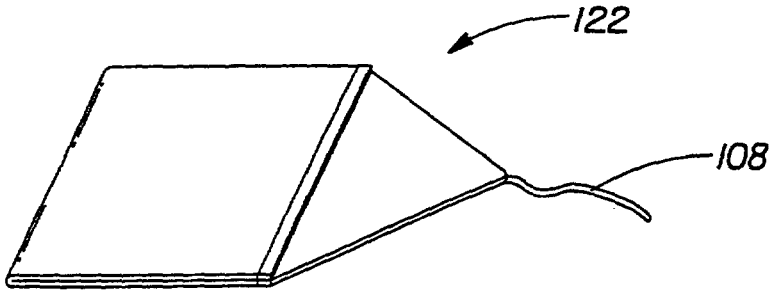
FIG. 17 is a perspective view of the wrap shown in FIG. 16 which has been folded once.
Figure 18:
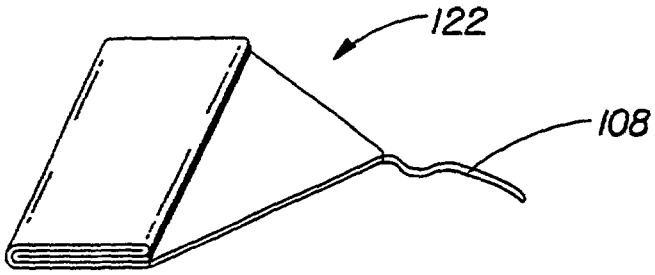
FIG. 18 is a perspective view of the wrap shown in FIG. 16 which has been folded twice.
Figure 19:
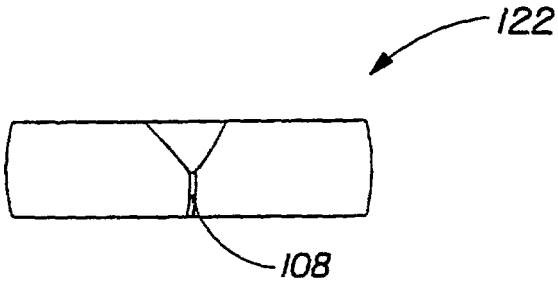
FIG. 19 is a perspective view of the wrap similar shown in FIG. 16 with the strap fastened around the folded wrap.

Referring to FIGS. 13, 14, and 15, still a further preferred flexible wrap container made in accordance with one aspect of the present invention is illustrated. The flexible wrap container 148 has a flexible panel 100 with a right edge, left edge, and bottom edge. Disposed adjacent each of the right and left edges of the panel 100 is a fence 150. The fences 150 can be provided in place of the previously described flaps for retaining a garment within a flexible wrap container. The fences 150 can be formed from a plurality of loops 152 whose ends 154 and 156 are attached to the flexible panel 100. The loops 152 can be formed from polyester filaments, or a similar material, and attached to the flexible panel 100 by stitching, heat sealing, hot glue, cold glue, ultrasonic welding, etc. The loops 152 are preferably formed into a first row 158, wherein the loops 152 of the first row are disposed end to end, and a second row 160, wherein the end of the loops are also disposed substantially end to end. Preferably, the first loop 162 of the second row 160 begins at about the mid-point of the first loop 164 of the first row 158, as shown in FIG. 13, and the opposite end of the first loop 162 of the second row 160 terminates at about the mid-point of second loop 170 of the first row 158, although the beginning location of the second row can be varied. The loops preferably lay substantially flat when the flexible wrap container is unrolled and are flexible enough to rise away from the flexible panel 100 such that loops from the first and second rows 158 and 160 will overlap to form the open fence 150 having openings 172, as best seen in FIG. 14, through which wash water can flow but which are small enough such that the garment is unable to exit the flexible container wrap 148 during use. The filaments forming the loops preferably have a gauge between about 0.25 mm and about 3.175 mm and the opening 172 have an open area between about 1.5 $cm^2$ and about 4.8 $cm^2$.

While the first and second rows 158 and 160 are described herein as distinct rows, it will be understood that a single row can be provided in place of two rows or that more that two rows can be used. Further, it will be appreciated that the gauge and spacing of the loops can be changed to achieve differing degrees of flexibility in the longitudinal direction and garment containment in the transverse direction. Further the longitudinal length of the fences 150 can be varied, although it is preferred that the length extend from adjacent to the top edge of the panel 100 to adjacent to the bottom edge of the panel 100.

The rolled or folded wrap can be placed in the washing machine in any suitable manner. The wrap is typically placed in a U.S. machine by bending it slightly to fit it around the agitator before the machine is turned on. The wrap can be placed in the washing machine without any special means to retain it in place. Alternatively, a suitable retaining device can be used to retain the wrap in a particular position in the tub of the washing machine.

Figure 20:
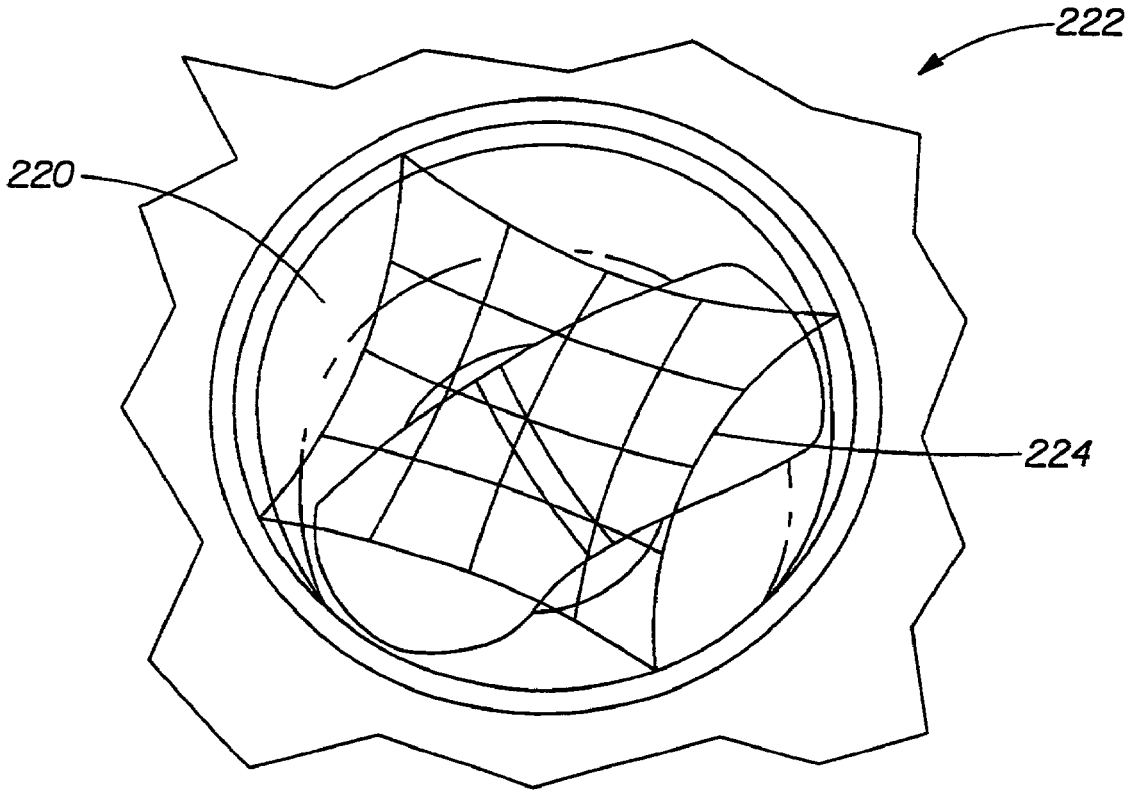
FIG. 20 is a perspective view showing the interior of the tub of a washing machine with a net therein to hold the folded flexible wrap container in position.

For example, as shown in FIG. 20, in one embodiment, when the wrap is placed in the tub 220 of the washing machine 222, a retaining device, such as a net 224 can be placed over the wrap to keep the wrap submerged and prevent the wrap from floating during the washing process. This will ensure that the garments contained in the wrap will be adequately wetted, and more completely cleaned. This is a particularly useful variation in the case of the mild wash conditions and short wash times in washing machines used in Japan where the water is circulated mainly horizontally by a disk at the bottom of the wash tub. These machines differ from U.S. machines where the water moves in a vertical circular motion which tends to pull the wrap down toward the bottom of the wash tub.

In the case of the embodiment shown in FIG. 20, a net 224 is used which extends across the interior of the tub of the washing machine, and is disposed over the wrap. The net can be stretchable or non-stretchable. The net can be of any suitable size. The net, may, for example, have a diagonal dimension of between 20–40 cm in an unstretched condition. The net can be of any suitable shape, including, but not limited to: square, rectangular, triangular, and circular. The net can be made of any suitable material. The net should be pervious so that it does not disturb the water flow in the washing machine. In one embodiment, the net is a stretchable elastic material which has a square configuration and is 22 cm×22 cm in an unstretched condition. This net has sixteen square-shaped apertures, each of which is approximately 5 cm×5 cm.

The net can be held in place in any suitable manner. In the embodiment shown in FIG. 20, the net is held in place by four metal hooks that engage with the holes in the inside of the tub of the washing machine. The net is not limited to being retained by four hooks. Any suitable number of hooks (including between 3–10 hooks) will do. The hooks can be made of plastic, or any other suitable material. In other embodiments, the net may be held in place by types of devices other than metal hooks. A few non-limiting examples of suitable devices for holding the net in place include: suction cups, magnets, and stickers.

In other embodiments, the retaining device can comprise some other suitable device other than a net. Any device that retains the wrap in place in the washing machine will be suitable. The wrap could, for example, be hooked to the tub with straps. Alternatively, the wrap could be weighted to keep it submerged. In other embodiments, the wrap can provided with magnets which can be attached to the interior of the wash tub to keep the same in position. These are but a few examples of suitable retaining devices.

The garment container preferably resists shrinkage of the garments contained therein such that the garments have a shrinkage ratio (% dimensional change) of less than or equal to about 15% (e.g., between about 0% and about 15%) over five wash cycles. The shrinkage ratio (% dimensional change) is measured according to the Entire Garment Shrinkage Test Method described in the Test Methods section below.

The garment container preferably has a wetting effectiveness of the garments contained therein of between about 90% and about 100%, more preferably at least about 95%, and most preferably 100%. The wetting effectiveness of the garments is measured according to the Wetting Test Method described in the Test Methods section below.

The flexible wrap container disclosed by the present invention provides significant benefits over similar devices in use today. In particular, it offers a superior means for securing and closing itself, thereby limiting the chance that garments will spill out of it and be damaged while being laundered in a washing machine. Additionally, the flexible wrap container insulates and protects the garment or garments contained therein from the stress and abrasion that may be caused by the agitator and other internal parts of a washing machine. The flexible wrap container further offers an expandability and versatility that is not seen in other such devices: not only is the flexible wrap container larger than competing devices, it has a series of connecting means (e.g. snaps) which allow two identical flexible wrap containers to be snapped together to provide an additional flexible wrap container of twice the original capacity of the flexible wrap container. This further enhances the dimension retention benefits of the present invention.

The Wash Pretreatment Applicator

Figure 5:
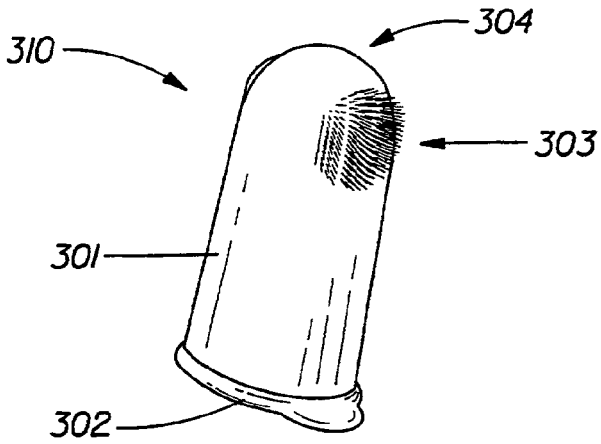
FIG. 5 is a perspective of the wash pretreatment applicator 310 which is used in the present invention to pre-treat stains using hand pressure.
Figure 6:
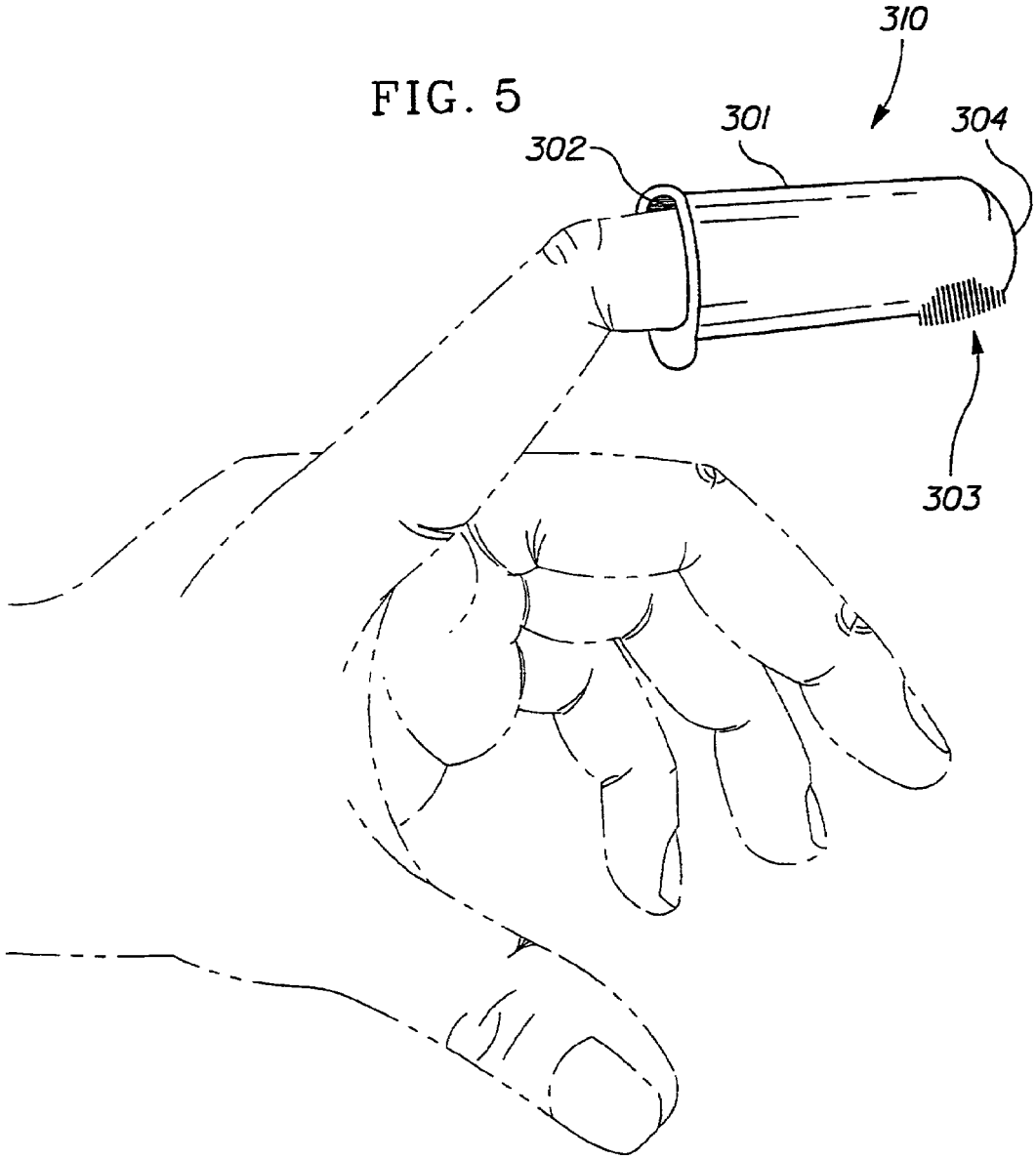
FIG. 6 is a perspective of the wash pretreatment applicator 310 as positioned on a human finger.

As shown in FIGS. 5 and 6, one style of wash pretreatment applicator employed in the stain-removal process of the present invention is a finger mounted brush suitable for spreading an amount of the pretreatment composition across the stained area of fabric which, along with a very gentle amount of force, allows the pretreatment composition to penetrate into the stain and provide efficacious cleaning benefits. This is, however, only one embodiment as the applicator in the present invention may be as simple as a human finger or any other non-abrasive tool which can apply an effective amount of a wash pretreatment composition to a stained area of a garment while simultaneously effectively providing mechanical action to assist in the stain removal.

FIG. 5 is a perspective illustration showing the applicator 310. The applicator consists of a substantially cylindrical tube 301 having an open end 302 and a closed end 304. The tube 301 is sized and configured to fit snugly around a human finger with the closed end of the tube positioned adjacent to the tip of the finger and the open end of the tube positioned adjacent the second joint of the finger. Brush means 303 are disposed adjacent the closed end portion 304 of the tube 301. The brush means is enclosed within a oval or circle-shaped area and extends generally from the tip of the tube and partially down the side of the tube.

The brush means 303 is conveniently configured to apply an effective amount of a wash pre-treatment composition to a stain covering a localized area of fabric when applied thereto with a brushing motion. The brush means comprises a multiplicity of small bristles provided as a bed or mat that extend outwardly from the closed end portion of the tube 301. The brush means may comprise from about 30 to about 250 bristles per $cm^2$. These bristles may be from about 0.05 to about 1.0 cm long. The bristles are formed as an integral part of the tube 301 during the manufacture thereof such that the bristles and the tube are all fabricated from the same unitary piece of material. The applicator may be made out of any flexible plastic or polymeric material and may be constructed so as to be either durable or disposable.

For aesthetic purposes, ease of manufacture or any other reason the bristles may be arranged in any pattern or grid provided that said pattern efficiently and efficaciously applies the liquid cleaning composition to the localized area of fabric. The choice of the source, style and number of bristles are matters for the manufacture's discretion, and the foregoing illustrations are not intended to be limiting of the invention.

The wash pretreatment applicator herein should be of a size that it comfortably fits on a human finger in the manner illustrated in FIG. 6. In this embodiment, the length of the tube 301 with its generally cylindrical configuration is about 4.5 cm. The diameter of the cylinder at its open end is 2 cm.

Figure 21:
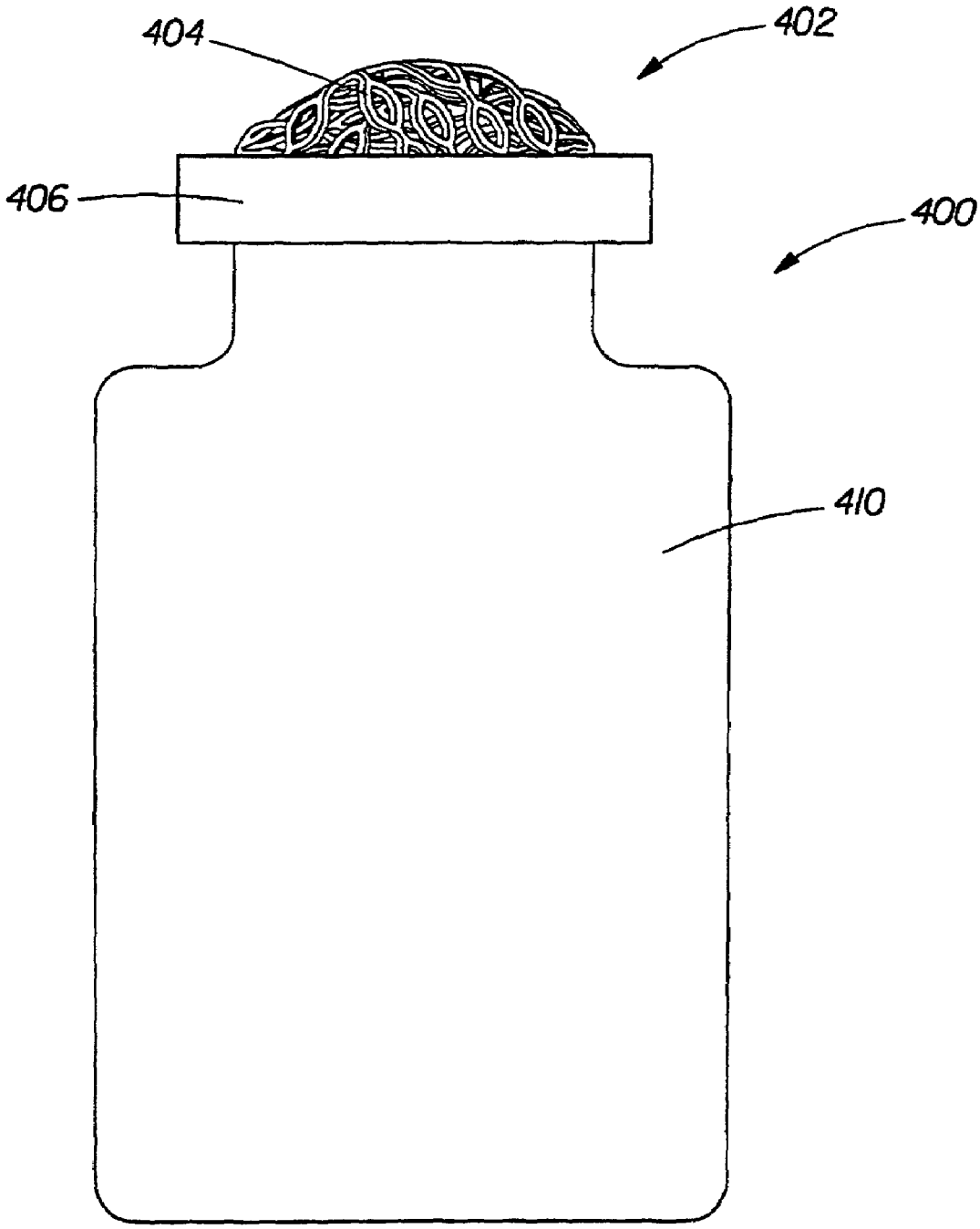
FIG. 21 is a perspective view of another embodiment of a pretreatment applicator.

FIG. 21 shows another embodiment of a wash pretreatment device 400. The pretreatment device 400 shown in FIG. 21 comprises a pressure operated dabbing-type applicator. The pretreatment device 400 preferably comprises an applicator portion or applicator 402 which comprises an applicator pad 404, an applicator fixture 406, and a valve 408, and a container 410. The valve 408 and container 410 are optional, but preferred components. In a simplified embodiment, the wash pretreatment composition can be applied to the applicator pad 404, and the composition can be applied to the garment, rather than the pretreatment composition flowing out of the container 410 and being metered by the valve 408.

The applicator pad 404 can be made of any suitable material. Suitable materials include, but are not limited to: foam, sponge, mohair, net, scrim, or other suitable material. In a preferred embodiment, the applicator pad 404 comprises a novel structure comprising multiple layers of a net or scrim material. Preferably, the applicator pad comprises a plurality of plies of a hydrophobic diamond mesh material net or scrim such as that shown in FIGS. 21–26. Suitable diamond mesh material is described in the following patents assigned to The Procter & Gamble Company: U.S. Pat. No. 5,650,384; U.S. Pat. No. 5,804,539; U.S. Pat. No. 5,977,039; and, U.S. Pat. No. 5,935,915, all issued to Gordon, et al.

In the preferred embodiment when the applicator pad 404 comprises the mesh, net, or scrim material described above, the applicator pad 404 preferably comprises a plurality of plies of this net material. There can be any suitable number of plies or layers of this net material. The number of layers depends on the thickness of each layer. A non-limiting example of a range of suitable number of plies is between 12 and 50 plies of material. In one preferred embodiment in which the net material is about 0.012 inches thick (about 0.3 mm), the applicator pad 404 comprises 28 layers of net material. Optionally, a variety of net applicator pads can be provided. For example, an applicator pad 404 with a coarser net material can be provided for heavier fabrics, and a finer net material can be provided for lighter weight fabrics.

The applicator pad 404 can be made in any suitable manner. Preferably, the applicator pad 404 is made in a way that the openings of the net are between about 0.100–0.180 inches (about 2.5 mm–4.6 mm), more preferably about 0.125 inches (about 3 mm). The openings in the different layers of the net material are preferably not aligned. This will provide the applicator pad 404 with greater capillarity than if the openings were all aligned. Preferably, the openings are randomly aligned.

One non-limiting way of making the applicator pad 404 involves using a stretchable net material with openings that are about 0.050 inches (about 1.3 mm). The net material is initially provided in the form of a long tube. The net is then pulled over a structure to stretch the net so that the openings are the desired 0.125 inches in size. The structure can be a tube such as a length of PVC pipe, or any other suitable structure. The net is then rolled up until it resembles a multi-layered sweat band. The net is rolled until there are 28 layers in the rolled up net. The net roll is heated and cooled to set the openings at the desired size. The net is then cut from around the pipe to form a band of multi-layered material.

Figure 22:
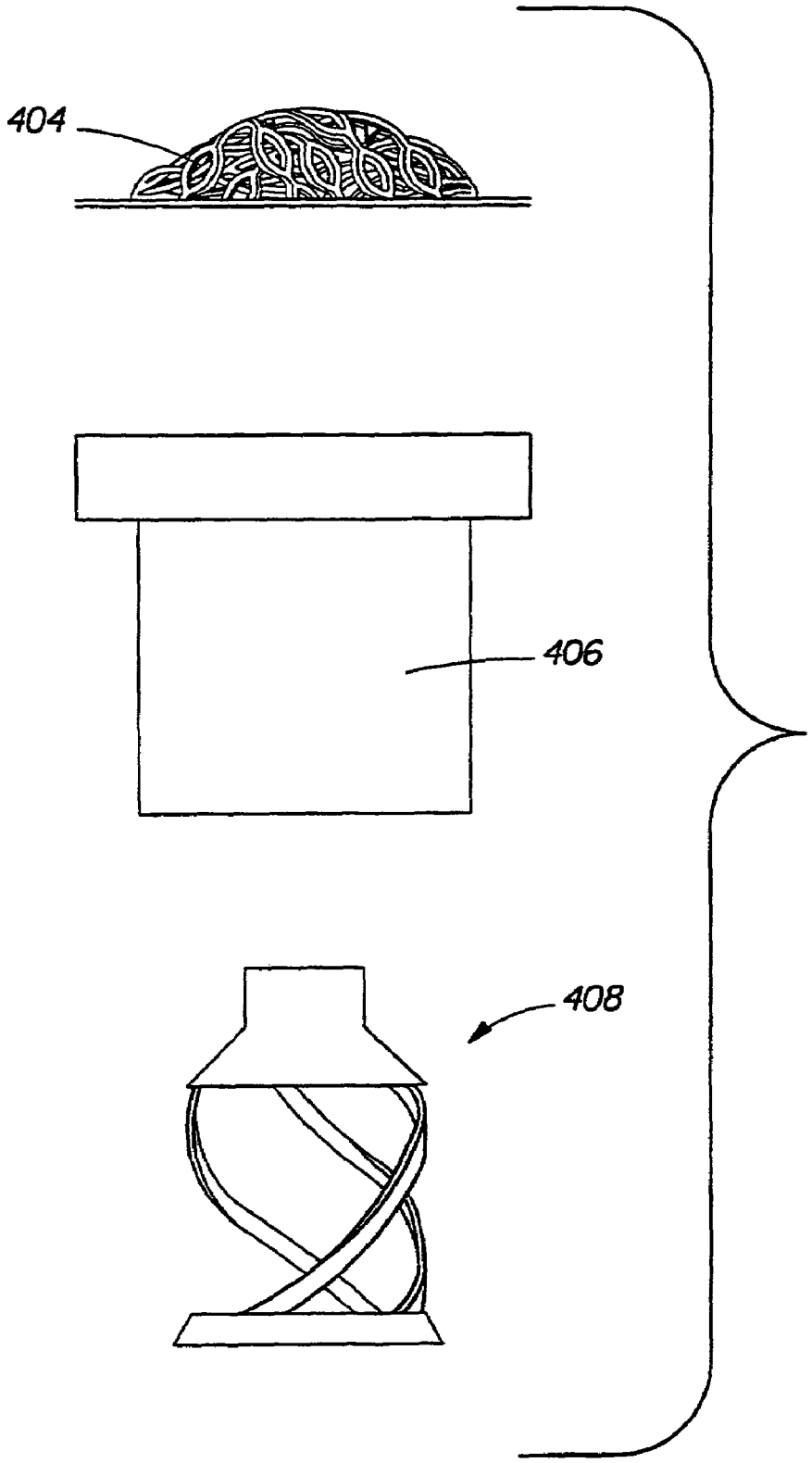
FIG. 22 is an exploded side view showing the assembly of the applicator portion of the pretreatment applicator shown in FIG. 21.
Figure 23:
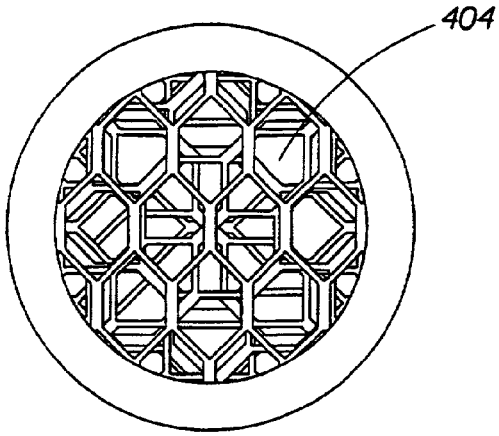
FIG. 23 is a top view of the of the applicator portion of the pretreatment applicator shown in FIG. 21.
Figure 24:
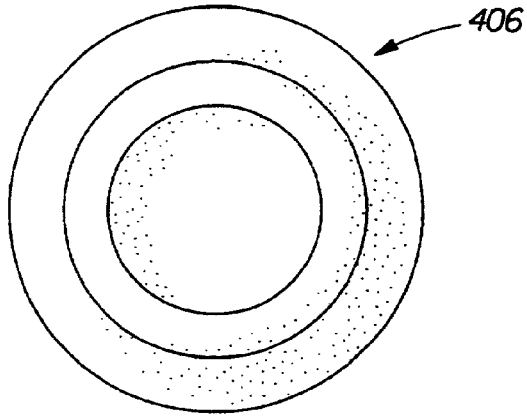
FIG. 24 bottom view of the applicator portion of the pretreatment applicator shown in FIG. 21.
Figure 25:
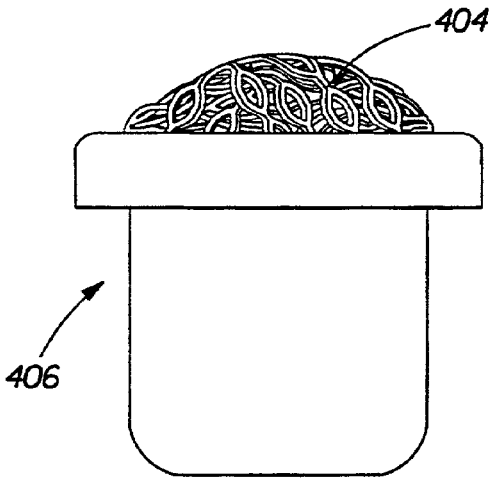
FIG. 25 side view of the applicator portion of the pretreatment applicator shown in FIG. 21.

The band of multi-layered material then is formed into individual buttons of a size suitable for serving as applicator pads. The FIG. 22 shows the applicator pad 404 when it is in the form of a button. The buttons can be of any suitable shape, but are preferably circular. The buttons are formed by ultrasonically welding and melting the perimeter of the multi-layered net material to form a flat lip or rim around a circular section of the multi-layered net material.

The fixture 406 can be any suitable structure that serves as a holder for the button, and preferably also houses the valve 408. Suitable fixtures are available from Dab-O-Matic Corp., Mt. Vernon, N.Y.

The valve 408 can be any suitable type of valve. Suitable types of valves include, but are not limited to: Archimedes valves, spring valves, etc. In a preferred embodiment, the valve is a spring valve such as one of those available from Dab-O-Matic Corp.

The container 410 can be any suitable type of container. The applicator 402 can be fit onto the container 410 in any suitable matter, including, but not limited to by screwing the same onto the container, or by friction fitting the applicator onto the container 410.

Figure 26:
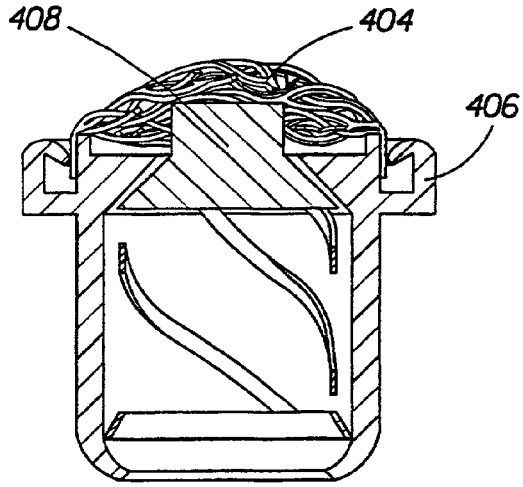
FIG. 26 cross-sectional side view of the applicator portion of the pretreatment applicator shown in FIG. 21.

FIGS. 22 and 26 show the assembly of the wash pretreatment device 400. The button is placed on top of the fixture 406. The rim of the applicator button is folded down around the top of the fixture 406 and fit onto the fixture as shown in FIG. 26.

The wash pretreatment device 400 with the net applicator pad 404 is soft on gentle fabrics. In addition, without wishing to be bound to any particular theory of operation, it is believed that the wash pretreatment device shown in FIGS. 21–26 aids in converting the wash pretreatment composition into a foam since air can be entrapped within the layers of netting. This is believed to provide better cleaning. Again, without wishing to be bound by any particular theory, the wash pretreatment device 400 is also believed to be unique in that it is capable of performing several functions simultaneously. The net applicator pad 404 is capable of: being used for scrubbing the stained portion of the fabric; foaming the pretreatment composition (even non-foam forms of the composition) to aid in suspending the stain soil particles from the stained area; and, it also has a capillary structure that for absorbing and removing the foam with suspended soil particles therein from the stained area of the garment so that the stained area can become progressively less stained (or refreshed) each time the applicator pad is brought into contact with the stained area of the garment.

In addition to being useful as a wash pretreatment applicator, the applicator can also be useful for other purposes, such as for cleaning or applying a liquid to virtually an unlimited number of other types of material, surfaces, including but not limited to skin. For example, the applicator can be useful for cleaning stains on fabrics that are not washed shortly thereafter, or it could be useful in removing stains from carpets. In another example, the applicator could also be used for applying medicaments to a living creature.

The wash pretreatment applicators are highly useful tools by which stain removal agent may be distributed over the stained area of a garment with enhanced convenience and efficacy.

Absorbent Stain Receiver

The absorbent stain receiver which is used in the present invention includes an absorbent material which imbibes the liquid composition. In preferred modes of operation, the stain receiver is designed specifically to "wick" or "draw" the liquid compositions away from the stained fabric. The absorbent stain receiver is necessarily white or non-printed to avoid dye transfer from receiver to garment. White or non-printed disposable paper towels, paper towels such as BOUNTY™ brand towels, clean rags, etc., can be used. A preferred receiver consists of a nonwoven pad. In a preferred embodiment, the overall nonwoven is an absorbent structure composed of about 72% wood pulp and about 28% bicomponent staple fiber polyethylene-polypropylene (PE/PP). It is about 60 mils thick. It optionally, but preferably, has a barrier film on its rear surface to prevent the cleaning liquid from passing onto the surface on which the spotting operation is being conducted. The receiver's structure establishes a capillary gradient from its upper, fluid receiving layer to its lower layer. The gradient is achieved by controlling the density of the overall material and by layering the components such that there is lower capillary suction in the upper layer and greater capillary suction force within the lower layer.

Alternatively, the absorbent stain receiver used herein comprises Functional Absorbent Materials ("FAM's") which are in the form of water-absorbent foams having a controlled capillary size. The physical structure and resulting high capillarity of FAM-type foams provide very effective water absorption, while at the same time the chemical composition of the FAM typically renders it highly lipophilic. Thus, the FAM can essentially provide both hydrophilicity and lipophilicity simultaneously. FAM foams can be treated to render them hydrophilic. Both the hydrophobic or hydrophilic FAM can be used herein.

The manufacture of FAM-type foams for use as the stain receiver herein forms no part of the present invention. The manufacture of FAM foam is very extensively described in the patent literature; see, for example: U.S. Pat. No. 5,260,345 to DesMarais, Stone, Thompson, Young, LaVon and Dyer, issued Nov. 9, 1993; U.S. Pat. No. 5,268,224 to DesMarais, Stone, Thompson, Young, LaVon and Dyer, issued Dec. 7, 1993; U.S. Pat. No. 5,147,345 to Young, LaVon and Taylor, issued Sep. 15, 1992 and companion patent U.S. Pat. No. 5,318,554 issued Jun. 7, 1994; U.S. Pat. No. 5,149,720 to DesMarais, Dick and Shiveley, issued Sep. 22, 1992 and companion patents U.S. Pat. No. 5,198,472, issued Mar. 30, 1993 and U.S. Pat. No. 5,250,576 issued Oct. 5, 1993; U.S. Pat. No. 5,352,711 to DesMarais, issued Oct. 4, 1994; PCT application 93/04115 published Mar. 4, 1993, and U.S. Pat. No. 5,292,777 to DesMarais and Stone, issued Mar. 8, 1994; U.S. Pat. No. 5,387,207 to Dyer, DesMarais, LaVon, Stone, Taylor and Young, issued Feb. 7, 1995; U.S. Pat. No. 5,500,451 to Goldman and Scheibel, issued Mar. 19, 1996; and U.S. Pat. No. 5,550,167 to DesMarais, issued Aug. 27, 1996.

Kits

In accordance with one aspect of the present invention, a kit is provided which contains the necessary materials to enable a consumer to clean their delicate or dry-clean only garments in a washing machine, such as a conventional, home washing machine with at least equivalent cleaning performance but without significant damage or the adverse effects typically associated with aqueous garment cleaning. In one non-limiting embodiment, the kit includes a liquid cleaning composition specially formulated for treating and cleaning delicate and dry-clean only garments, which is preferably a combination washing/conditioning detergent composition, and a flexible wrap container. The kit may also include: a wash pretreatment composition, one or more wash pretreatment applicators, a rinse cycle conditioner, an apparatus for dispensing a rinse cycle conditioner and multiple absorbent stain receiver pads.

When these separate components are taken and used together, the result is an innovative process and a kit for performing that process by which delicate and dry-clean only garments can be cleaned and freshened in an aqueous laundering process without damaging the garments.

Process Embodiments

The use of the devices, compositions and processes of this invention are described in more detail hereinafter. Such disclosure is by way of illustration and not limitation of the invention herein.

Although not necessary or essential to the present invention, it is preferable to use a pretreatment procedure to improve the effectiveness of removing stains from a stained area of the garment. This pretreatment procedure comprises pouring a pretreatment composition to the stained area and then distributing and spreading the pretreatment composition over the stained area with the wash pretreatment applicator by applying a gentle brushing motion to distribute the pretreatment composition around the stained area of the garment. The pretreatment composition and loosened soil is then optionally rinsed off the treated area with water.

In more detail, the pretreatment process herein can be conducted in the following manner. Modifications of the process can be practiced without departing from the spirit and scope of the present invention.

1. Place the stained area of the garment over and in contact with an absorbent stain receiver such as a FAM absorbency pad or a paper towel (preferably a nonwoven pad that is white or non-printed-to avoid dye transfer from receiver to garment) or any other stain receiver as described herein on any suitable surface such as a table top etc. Pour the wash pretreatment composition onto the stained area.

2. Use the wash pretreatment applicator to spread, in a gentle brushing motion, the pretreatment composition onto the stained area to saturate the localized stained area without saturating the area surrounding it and then subsequently attempting to work out the stain as completely as possible.
3. Optionally, let the composition penetrate the stain for about 1 to 30 minutes.
4. Optionally, apply more of the pretreatment composition onto the stained area.
5. Optionally, rinse the stained area that has been pre-treated with cold tap water.
6. Follow this pretreatment process with the overall cleaning process described below.

An overall process for treating an entire fabric surface area of a garment, which includes the pretreatment process described above, thus comprises the following steps of:

(i) Optionally, conducting a pretreatment process, according to steps 1–6 of the above disclosure, on a stained area of a garment.

(ii) Placing the pretreated garment from step (i) inside the washing implement in the manner disclosed herein and securing the washing implement so that it will not come open during laundering in the washing machine.

(iii) Placing the washing implement inside a washing machine together with a measured amount of the combination washing/conditioning composition.

(iv) Operating the washing machine on its most gentle agitation cycle and using cold water both in the wash and rinse cycles for a period of at least about 6 minutes, typically from about 4 minutes to about 12 minutes.

(v) Removing the flexible wrap container containing the clean garments from the washing machine, removing the garment or garments from the flexible wrap container and either allowing them to air dry or first placing them in a clothes dryer set on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. The garments should then be removed and allowed to air dry. Wool garments should not be placed in a clothes dryer.

With respect to step (ii), it is appreciated that for fabrics which tend to wrinkle, it is preferred not to overload the washing implement used herein.

In step (iii), the washing machine may have an agitator arranged on either a substantially horizontal or substantially vertical axis. Typically, such an amount of liquid cleaning/conditioning composition will be added so that the concentration of active ingredients in the wash liquor is from about 300 ppm to 2500 ppm, more preferably from about 400 ppm to about 2000 ppm, most preferably from about 500 ppm to about 1600 ppm. Step (iv) can be conducted for longer or shorter periods, depending on such factors as the degree and type of soiling of the fabrics, the nature of the soils, the nature of the fabrics, the fabric load and the like according to the needs of the user.

The components of the methods described in U.S. patent application Ser. Nos. 60/105,539, 60/157,082, and 60/157,399 (PCT Publication WO 00/24860 published in the name of Wernicke, et al. on May 4, 2000, and PCT Publication WO 00/24958 published in the name of Curry, et al. on May 4, 2000), could be substituted for one or more of the component parts of the method described herein.

EXAMPLE I

The following provides non-limiting examples of a (1) preferred wash pretreatment composition to be used in the pretreatment process; and (2) a washing/conditioning composition to be added during the wash cycle. It should be understood that all of the amounts are approximate (or "about") the amounts listed. It should also be understood that the components are mixed together to form the compositions. The compositions are used in a manner described after the detailed formulations.

Wash Pretreatment Composition

| Component | Weight % |
|---|---|
| Nonionic Surfactant | 1–10% |
| Anionic Surfactant | 10–30% |
| Amine Cosurfactant | 0–3% |
| Citric Acid | 1–4% |
| Ethanol | 1–3% |
| Monoethanol amine | 0.5–7% |
| Trimethyl pentanediol (TMPD) | 0.5–5% |
| Propanediol | 1–10% |
| Tolulene Sulfonate | 1–5% |
| NaOH | to adjust pH |
| Fabric Care Agents | 1–5% |
| Enzymes | 0.1–2% |
| Water and perfume | Balance |

Washing/Conditioning Composition

| Component | Weight % |
|---|---|
| Anionic Surfactant[1] | 10–25% |
| Nonionic Surfactant[2] | 1–6% |
| Lauryl trimethyl ammonium chloride | 1.5–12.5% |
| Trimethyl pentane diol (TMPD) | 0.5–5% |
| Citric Acid | 1–4% |
| Ethanol | 1–3% |
| Monoethanol amine | 0.5–7% |
| Sodium Formate | 0.05–2% |
| Propanediol | 1–10% |
| Tolulene Sulfonate | 1–5% |
| Borax premix | 0.5–2.5% |
| NaOH | to adjust pH |
| Ethoxylated Tetraethylene Penatamine | 0.5–2% |
| PVNO | 0.1–1.5% |
| Cyclic Polymer[3] | 0.1–1.5% |
| Enzymes | 0.1–2% |
| Silicone softening agent[4] | 1–12% |
| Perfumes and dyes | 0.2–1% |
| Water, anti-foam agents, and optionally leather conditioners | Balance |

1: C12–15 alkyl ethoxy sulfonate containing an average of 1.1 ethoxy groups.
2: Neodol 23-9
3: Imidazole-epi (condensation oligomer produced by condensation of imidazole and epichloro-hydrin in the ratio 1:4:1). The composition is about 94% oligomer and 6% free imidazole
4: The silicone softening agent may be either a blend of Dimethicone and Ammonium alkyl sulfonate containing an average of 3 ethoxy groups or may be the SILWET® L77 surfactant which is a mixture of 84% polyalkyleneoxide modified heptamethyltrisiloxane (the "active" ingredient) and 16% allyloxypolyethyleneglycol methyl ether and SILWET® L7602 surfactant. The silicone softening agent may be in the form of an emulsion.

Process Example

Step 1. One or more garments to be cleaned and refreshed are selected. Stains on a garment from sources such as ink, lipstick, salad dressing, collar soil and other similar sources are then identified and selected for pretreatment. For pretreatment, localized stained areas of the garment are situated over a paper towel and are treated by directly applying about 0.5 to 5 mls (depending on the size of the stain) of the wash pretreatment product of Example I, which is gently worked into the garment using the wash pretreatment applicator. Excess liquid product is then washed off the stain with running cold tap water.

Step 2. The flexible wrap container is laid flat on an even surface such as a table or clothes dryer. A first garment such as a jacket is placed on the wrap. The sleeves and other extensions of the garment should be folded-in if necessary and none of the garment may lie outside the perimeter of the wrap. After the first garment has been laid on the wrap, the wrap's flaps are folded over the garment so that the entire garment is enclosed by the wrap. An additional garment may then be placed over the folded flaps following the same procedure described above and being careful that none of the garment lies outside the perimeter of the flexible wrap container.

Step 3. The wrap is then rolled up as if one were rolling up a sleeping bag. The wrap is rolled in a direction parallel to the longest edge of the wrap, starting from the edge furthest from the straps. After the bag has been rolled up, it is secured by means of the straps and fasteners so that the straps holding the bag are pulled taut.

Step 4. The garment-containing wrap is then placed in a washing machine. Preferably two garment-containing wraps of approximately equal weight are placed in the washing machine simultaneously to insure a balanced load. The washing machine settings should be set on: medium water level (approximately 17 gallons), cold water and the most gentle agitation setting. About 70 grams of the washing/conditioning composition of Example I are poured into the washing machine; 70 grams of the liquid product of Example I in 17 gallons of water means that the total concentration of liquid cleaning composition in the detergent/water solution will be about 1090 ppm.

Step 5. When the washing machine has completed all of its cycles, the garment-containing wraps are removed from the washing machine and the garments inside the wraps are removed from the wrap. With the exception of men's ties and wool garments, one may dry the garments by placing them in a dryer and setting the dryer on air-fluff (no heat) for silk garments or the lowest possible dryer heat setting for garments made from rayon and rayon blends. Heavy weight garments should remain in the dryer for 8 to 10 minutes, while light weight garments should remain for 4 to 6 minutes. One then removes the damp garment from the dryer and may then hang the garment or lay it flat to finish drying. For men's ties and wools the dryer step is inappropriate and air drying should begin immediately after they are removed from the washing machine.

Step 6. Press or steam the garments if necessary.

Test Methods

Wetting Test Method

Standard Wash Conditions:
Washing Machine (Sears Kenmore Series 90)
Medium Water Fill (17 gallon) (64 liters)
Cold Water Temperature (60° F.) (15.5° C.) for both wash and rinse
Extra Delicate Agitation Setting
6 minute "Ultra Clean" wash cycle
1 Rinse Selected Procedure:

Wetting Experiment

1. Place a 100% wool sweater in the garment wrap. Place the sleeves straight down along the sides of the sweater (not crossing in the middle so as to avoid covering the front of the sweater, which would interfere with wetting of the same).
2. Roll up the garment wrap in the usual manner.
3. Using Standard Wash Conditions, turn on the washing machine and allow washing machine to fill.
4. Once water has filled and agitation has started, place garment wrap with the sweater therein on the surface of the water in the machine (do not submerge). (This wetting experiment is designed to measure the garment wetting in a stressed condition in that wetting is typically easier to accomplish when the garment wrap is placed into the wash tub before the water fills the wash tub.)
5. At the end of the wash cycle, the machine will begin to drain.
6. After the machine has finished draining, turn off the machine before the spin cycle begins.
7. Lay the garment wrap on a flat table and unroll or unfold the wrap.
8. Immediately begin measuring and recording the dry areas on the front of the sweater and both sides of the arms (dry areas will appear much lighter than the wet areas). The dry areas are measured by measuring the dimensions of the dry areas using a scale (ruler) and calculating the area of each dry area as accurately as possible.
9. To calculate an approximate % Dry, divide the sum of the dry areas by the measured area of front and arms. The wetting effectiveness is determined by subtracting the % Dry from 100%.

Shrinkage Test Method—Entire Garment

This procedure is for preparing and evaluating entire garments for measuring fabric shrinkage.

Definitions:

Dimensional Change (DC)—changes in fabric length or width. Expressed as a percentage of the initial dimension of the fabric.

Shrinkage—a dimensional change resulting in a decrease in length or width of the fabric specimen.

Procedure:

Garment Preparation:

1. Identify and obtain three different types of garments for evaluation. Recommended fiber types include: rayons, rayon/acetates, silks and wools. Include both woven and knitted fabrics as well as a variety of garment construction types (dresses, blouses, pants, blazers, skirts).

Figure 27:
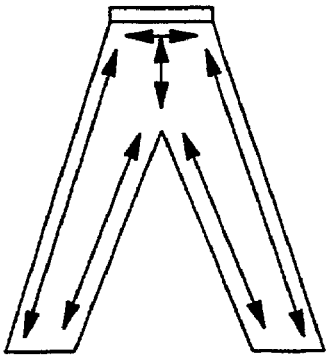
FIG. 27 is a schematic view showing the garment benchmark locations for a pair of pants or trousers for the entire garment shrinkage test method.
Figure 28:
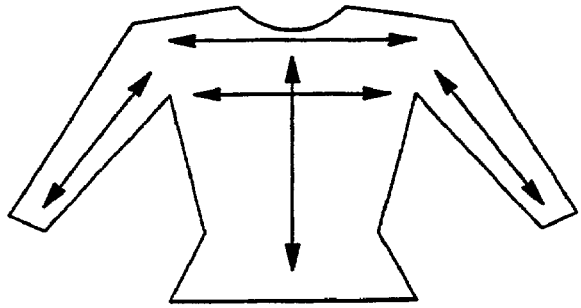
FIG. 28 is a schematic view showing the garment benchmark locations for blouses, shirts, and sweaters.
Figure 29:
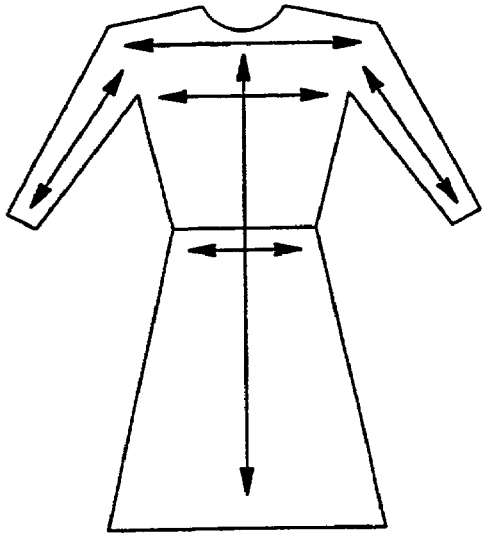
FIG. 29 is a schematic view showing the garment benchmark locations for dresses and skirts.

2. Four garments of each sample should be used to increase the precision of the average.
3. Condition each garment for at least 4 hours in a controlled environment room (70° F., 65% RH) by hanging it on a hanger. If a garment would not normally be hung on a hanger, lay garment on a screen of a conditioning rack.
4. Using indelible marker or sewing thread, place pairs of benchmarks on the garment using FIGS. 27 to 29 as a guide for the location of benchmarks. FIG. 27 shows the location of benchmarks for a pair of pants or trousers. FIG. 28 shows the location of benchmarks for shirts, blouses, and sweaters. FIG. 29 shows the location of benchmarks for dresses and skirts. The benchmarks are located generally from one portion of the garment to the corresponding opposing portion of the garment (e.g., from the bottom of the pants leg to the top of the pants leg). The precise location of each benchmark is not important because the dimensional change of the garment is being measured, rather than absolute dimensions of the different portions of the garment. Typically, the benchmarks chosen will be a whole number of (e.g., inches or centimeters), rather than a number and a fraction of a number. However, each benchmark must be at least one inch (2.5 cm) inward from all edges or seams.
5. If the garment shifts or moves when you attempt to place the benchmarks, lay the garment flat on a board and fasten the garment to the board with needles or tacks without stretching the fabric.
6. Measure and record the distance between each pair of marks to the nearest millimeter or sixteenth of an inch. Record these distances on a piece of paper under a column designated "A".

Wash/Dry Instructions:

1. Place no more than two garment wraps in the washing machine specified above under Standard Wash Conditions.
2. Set the water temperature to 60° F., the agitation to Extra Delicate (Kenmore Series 90), and the cycle setting to "6 minute Ultra Clean".
3. Set the water fill to 17 gallon (Medium on Kenmore Series 90) and start the machine. Select one rinse.
4. Add product.
5. Once the final spin has completely stopped, remove wraps from machine and lay on flat surface.
6. Unroll wraps, remove garments, and dry as follows:
   for rayon and rayon/acetate fiber: dryer dry with Low heat for 5–10 minutes then hang to finish drying;
   for silk fiber: dryer dry with no heat (Air Fluff) for 10 minutes then hang to finish drying; and
   for wool fiber: lay flat or hang dry.

Measurements and Evaluation:

1. After completion of the shrinkage test, condition each garment for at least 4 hours in a controlled environment room (70° F., 65% RH) by hanging it on a hanger. If garment would not normally be hung on a hanger, lay garment on a screen of a conditioning rack.
2. After conditioning, lay each garment without tension on a flat, smooth, horizontal surface. If the garment is heavily wrinkled and can not be laid flat, fasten the garment to a board without stretching the fabric.
3. Measure the distance between each pair of marks—record these under a column designated "B". Small wrinkles should be flattened out with the ruler.
4. Calculate dimensional change for each location on the garment:

$$\% DC = 100(B-A)/A$$

where DC=Dimensional change
   A=Average original dimension
   B=Average dimension after wet cleaning
   Both original (A) and final (B) dimensions are the averages of the measurements in each location made on the three test garments.
5. Report the average dimensional change for each location on the garment for each fabric type and garment type.

Shrinkage Test Method—Fabric Swatches

This procedure is used for preparing and evaluating swatches for measuring fabric shrinkage.

Definitions:

Dimensional Change (DC)—changes in fabric length or width. Expressed as a percentage of the initial dimension of the fabric.

Shrinkage—a dimensional change resulting in a decrease in length or width of the fabric specimen.

Figure 30:
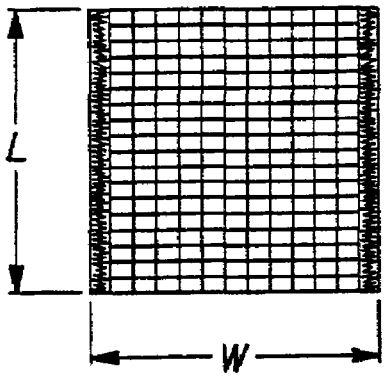
FIG. 30 is a plan view of an example of a woven fabric swatch.
Figure 31:
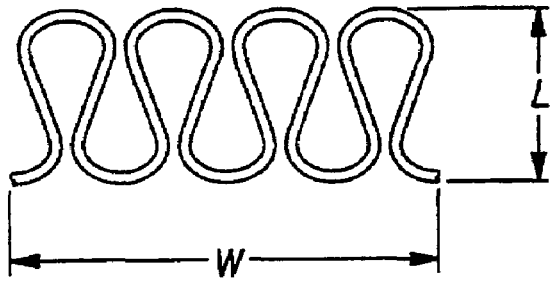
FIG. 31 is an enlarged plan view of a yarn as it would appear in a knit fabric swatch.
Figure 32:
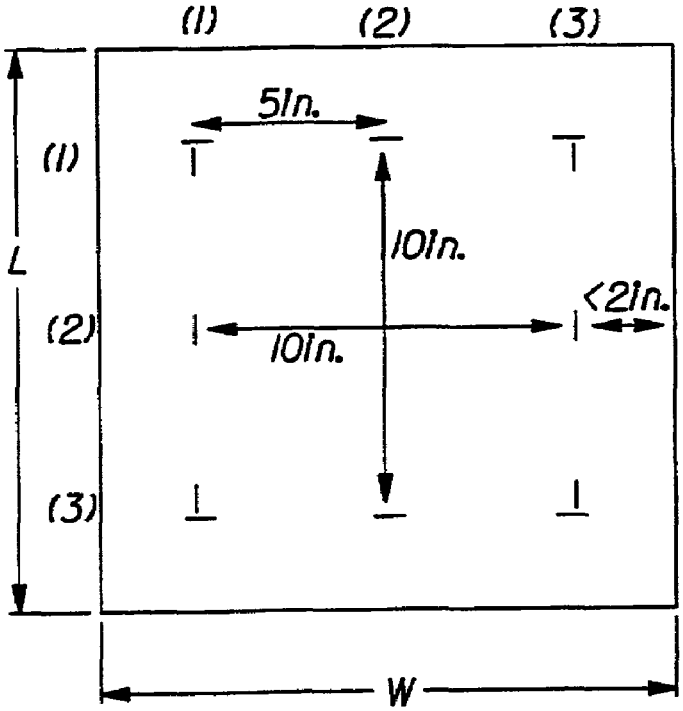
FIG. 32 is a plan view of the swatch marking template for the Fabric Swatch Shrinkage Test Method.

Procedure:

Swatch Preparation:

1. Identify and obtain fabrics or garments for evaluation.
2. Cut three 14 in.×14 in. (35.6 cm×35.6 cm) or larger swatches of each type of fabric for each test leg.
3. Condition swatches for at least 4 hours in a controlled environment room (70° F., 65% RH) by laying swatches flat on a screen or shelf of a conditioning rack.
4. Determine the lengthwise and widthwise directions of the swatch. For woven fabrics, see FIG. 30. For knit fabrics, examine the yarns and use FIG. 31 to determine the lengthwise direction. If the lengthwise and widthwise directions of the fabric can not be determined, measure area shrinkage only.
5. With indelible ink, mark each swatch with three pairs of marks, 10 in. (25.4 cm) apart, parallel to the length of the swatch and three pairs of marks parallel to the width of the fabric. Marks should not be made less than 2 in. (5.1 cm) from the border of the swatch. Pairs of marks in the same direction should be approximately 5 in. (12.7 cm) apart. See FIG. 32 for swatch marking template.
6. Measure the distance for each pair of marks—record these on a piece of paper under a column designated "A".

Measurements and Evaluation:

1. After the shrinkage test has been conducted, condition fabrics for at least 4 hours in a controlled environment room (70° F., 65% RH) by laying swatches flat on a screen or shelf of a conditioning rack.
2. After conditioning, lay each swatch without tension on a flat, smooth, horizontal surface.
3. Measure the distance between each pair of marks—record these under a column designated "B". Wrinkles should be flattened out with the ruler.
4. Calculate average lengthwise and widthwise dimensional change for each fabric type:

$$\% DC = 100(B-A)/A$$

where DC Dimensional change
   A=Average original dimension
   B=Average dimension after wet cleaning
   Both original (A) and final (B) dimensions are the averages of the measurements made in each direction on all three test swatches.

5. Calculate average area dimensional change of each fabric type according to the following equation:

$$\% DC_{area} = 100(B_{length}B_{width} - A_{length}A_{width})/A_{length}A_{width}$$

| | |
|---|---|
| where $DC_{area}$ = | Average area dimensional change |
| $A_{length}$ = | Average original lengthwise dimension |
| $A_{width}$ = | Average original widthwise dimension |
| $B_{length}$ = | Average lengthwise dimension after wet cleaning |
| $B_{width}$ = | Average widthwise dimension after wet cleaning |

Taber Stiffness

The test used to measure stiffness is the Taber tester (ASTM D5342). The samples of material are measured in two directions—parallel to the warp yarns and perpendicular thereto (parallel to the weft yarns). The Taber Stiffness is measured on four samples of material for each direction measured.

This concludes the description of the test methods.

The disclosure of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention.

What is claimed is:

1. A woven acrylic coated polyester garment container for use in a washing machine, comprising:

at least one panel for enclosing a garment and having a plurality of apertures; and wherein the clothes in said garment container have a shrinkage ratio of less than or equal to 15% over five wash cycles and wherein said at least one panel comprises structural elements wherein said structural elements are permeable to water.

2. The garment container of claim 1 wherein said garment container has a garment wetting effectiveness of between about 90% and about 100%.

3. The garment container of claim 1 wherein the material forming said panel has a stiffness of at least about 3 Taber Stiffness Units.

4. The garment container of claim 1 further comprising a second panel and a third panel attached to said at least one panel at opposite edges of said at least one panel such that said second and third panels can be folded about their respective edges to enclose the garment.

5. A kit for use in laundering delicate garments, comprising:

a garment container according to claim 1; and liquid cleaning composition comprising:

(a) an anionic surfactant;

(b) a quaternary ammonium surfactant;

(c) a silicone softening agent; and (d) a solvatrope;

wherein the weight ratio of anionic surfactants to quaternary ammonium surfactants is from 2:1 to 6:1.

* * * * *